US006478071B1

(12) United States Patent
Workman et al.

(10) Patent No.: US 6,478,071 B1
(45) Date of Patent: Nov. 12, 2002

(54) SLIDING HEADRAIL AND SHADE LEVELING SYSTEM FOR SPECIALTY WINDOW SHADES

(76) Inventors: Brian G. Workman, 20-D S. Nome Street, Aurora, CO (US) 80012; Paul T. Rogers, 825 Dahlia St., #506, Denver, CO (US) 80220

( * ) Notice: Subject to any disclaimer, the term of this patent is extended or adjusted under 35 U.S.C. 154(b) by 0 days.

(21) Appl. No.: 09/497,557

(22) Filed: Feb. 3, 2000

Related U.S. Application Data

(60) Provisional application No. 60/171,284, filed on Dec. 21, 1999, provisional application No. 60/158,857, filed on Oct. 12, 1999, and provisional application No. 60/118,889, filed on Feb. 5, 1999.

(51) Int. Cl.[7] ..... A47H 5/00

(52) U.S. Cl. ..... 160/84.04; 160/84.06; 160/169 R

(58) Field of Search ..... 160/84.01, 84.04, 160/84.05, 84.06, 84.07, 169 R, 167 R

(56) References Cited

U.S. PATENT DOCUMENTS

| | | | | |
|---|---|---|---|---|
| 4,518,025 A | | 5/1985 | Judkins | 160/84 R |
| 4,699,196 A | * | 10/1987 | Elliott | |
| 4,813,468 A | * | 3/1989 | Fraser | |
| 4,934,436 A | | 6/1990 | Schnebly | 160/84.1 |
| 5,002,112 A | | 3/1991 | Schnebly et al. | 160/84.1 |
| 5,092,383 A | | 3/1992 | Niemeijer et al. | 160/84.1 |
| 5,197,526 A | | 3/1993 | Schon | 160/84.1 |
| 5,207,257 A | | 5/1993 | Rupel et al. | 160/84.1 |
| 5,632,316 A | * | 5/1997 | Cohen | |
| 5,791,390 A | * | 8/1998 | Watanabe | |
| 5,823,241 A | * | 10/1998 | Sitzes et al. | |
| 5,860,464 A | * | 1/1999 | Schon | |

FOREIGN PATENT DOCUMENTS

| | | | |
|---|---|---|---|
| DE | 40 37 264 A1 | 11/1990 | E06B/9/262 |
| DE | 4037264 | 5/1992 | |
| EP | 0 058 459 A1 | 2/1982 | E06B/9/262 |
| EP | 0 058 459 B1 | 11/1985 | E06B/9/262 |
| EP | 534 261 A2 | 9/1992 | E06B/9/24 |
| JP | 404269919 A | 9/1992 | A47H/23/04 |
| WO | PCT/EP92/00382 | 2/1992 | E06B/9/262 |

* cited by examiner

*Primary Examiner*—Blair M. Johnson
(74) *Attorney, Agent, or Firm*—Dorr, Carson, Sloan & Birney, P.C.

(57) ABSTRACT

The object of the present invention is to provide window coverings for nonrectangular windows and openings. The present invention utilizes a sliding headrail which allows a shade to be fitted exactly to a myriad of nonrectangular window shapes and to be opened or closed without placing undue stress upon the shade material or causing unsightly bunching of the shade material. A single headrail may also be used in appropriate circumstances. The sliding headrail keeps shade material neat and flat within the window frame, and if pleated or honeycombed, maintains the pleats in their natural horizontal arrangement. The window shade is not limited to the use of any particular shade materials, and can use virtually any window covering material depending on the appropriateness of the application. Shade material is attached to the sliding headrail segments at various points via shade leveling rods and support rods. The shade leveling rods allow the shade material to remain horizontally level regardless of whether the shade is partially or fully open or closed. This benefit is especially apparent when the shade material used is pleated. The regular spacing of attachment points along the edge of the shade material reduces the stress due to drawing the shade open or closed placed upon any one point, ensures the appropriate distribution of the shade in the frame, and prevents drooping of lateral ends. The shade leveling rod also prevents the stress associated with drawing shade material into nonrectangular areas such as pitches, peaks, and arches. Also attached to the sliding headrail, the support rods run along the width of and are fastened to the shade, either internal or external to the shade material, to provide further distributive support.

27 Claims, 27 Drawing Sheets

SLIDING HEADRAIL AND SHADE LEVELING SYSTEM FOR SPECIALTY WINDOW SHADES

This application claims the benefit of provisional applications Serial No. 60/171,284 filed Dec. 21, 1999, Ser. No. 60/158,857 filed Oct. 12, 1999, and Ser. No. 60/118,889 filed Feb. 5, 1999 pursuant to 35 U.S.C. §§ 119(e) & 120.

FIELD OF THE INVENTION

The present invention relates to draw-pull window shades or blinds for use in residential or commercial applications. The shade mechanisms disclosed herein are ideally disposed to applications involving nonrectangular window shapes such as peaked, diagonal, or triangular frames, arches, arcuate sections, and other partial or full elliptical forms.

BACKGROUND OF THE INVENTION

This invention fills a need for well constructed and aesthetically pleasing shades and blinds, for interior or exterior application, for nonrectangular window shapes or other openings increasingly being used in modern residential and commercial construction. Such shapes can include triangles, pitched tops, peaks, arches, arcuate sections, and full or partial elliptical forms. Such window shapes lend great character to modern residential and commercial architecture. However, owing to this same character, these windows are extremely difficult to shade in a manner which is at once aesthetically pleasing, fitted to the shape of the frame, and structurally sound. Several attempts have been made to address this challenging problem, but results have heretofore been inadequate.

With pitched, peaked, and triangular windows, the difficulty of providing a workable shade lies in the inability to adequately cover the acute angular portion at the window's apex. Stop-gap solutions have included covering only the rectangular portion of the window with a conventional shade leaving the angular apex exposed. In situations wherein the angle of the apex is less severe, a top rail has been installed along the length of the pitched lintel and the shade or blind material has been trimmed to fit the angle and attached to this rail. However, the lower rail of the shade upon which the material stacks when raised must be shorter than the top rail in order to travel through the narrower rectangular portion of the frame. This means that the lower rail must either stop its ascent at the cusp of the pitched portion, leaving the angular apex covered, or only one side of the lower rail may continue to be raised toward the apex. This is an undesirable solution because the shade material is subjected to the stress of being pulled toward the stationary end of the lower rail, which being shorter in length than the upper rail, its opposite end will not coincide with the apex when fully drawn. Because of this the shade material is likely to bunch at best and tear at worst. Additionally, either two draw cords or some other tension relieving method is required for the differing travel distances of each side of the lower rail.

Another detraction to present offerings in pitched or triangular window shades is that they are generally mounted in the lintel of the window frame rather than the sill. In most applications such windows are placed higher on walls toward the peaks of roof lines to accentuate the building architecture. Therefore when one looks out of these windows, one must look up at them. With shades of prior manufacture installed and opened, one sees a morass of mounting equipment and bunched shade material at the lintel of the window instead of the more aesthetically pleasing lines of the window itself. In many of these applications it would be preferable to place the mounting equipment and folded shade material on the sill which obscures the lower part of the window anyway when one is looking up at the window from a position below.

Even fewer options were available for covering windows with arched shapes until the advent of accordion pile and honeycomb shade materials. These materials allow for various degrees of arched shapes to be covered using a fan method. In those designs, the pleated or honeycomb material is constricted at one end while the opposite end is splayed open to fill the arch. Although such solutions generally cover the window, there are significant aesthetic drawbacks. First the bunching of the material at the point of constriction can be unsightly. This bunching also results in the folds of the material extending radially which is usually in marked contrast to the blinds on adjacent windows in which the folds are generally horizontal. This can be visually dissonant. Further, a circular opening remains at the pivot point, due to the limitations of bending a straight edge into an arc, which must be obscured by some additional facade.

The present invention is a significant improvement over prior alternatives and accomplishes the desired end with a more aesthetically pleasing appearance.

DESCRIPTION OF RELATED ART

Schnebly (U.S. Pat. No. 4,934,436) (Schnebly I) discloses shade systems for covering arched windows. In one embodiment, pleated or honeycomb fabric is trimmed into an arched configuration and is fixedly mounted to the sill. It is raised to cover the window by means of a continuous cord under constant tension attached at a fixed point to the top pleat of the shade material. A problem with this design arises from the stress placed upon a single point of the shade material engaged for raising and lowering its entire weight and structure. Similarly, the outer edges of the top surface of the shade are not supported. This requires a limitation of available shade materials to those with sufficient horizontal stiffness or structure, such as honeycomb, to prevent the sides of the shade from sagging. In practice, even the more rigid materials droop over longer spans. Additionally, when lowered, the pleats, if more rigid, tend to splay out in a fan shape rather than lay flat.

Schnebly I also discloses a system for covering arcuate windows via two hinged edge rails. Each pleated edge of pleated or honeycomb shade material is attached to each edge rail respectively, in essence forming a fan with the hinge providing ability to adjust the splay of the fan. In one embodiment the fan must be manually placed within or removed from the window frame which limits its usefulness, especially for windows placed high on a wall in a room with a vaulted ceiling. Another embodiment employs a drawstring, but its application is limited to windows of acute angles as gravity is required to collapse the fan and return the shade to a closed position. With both designs there are the additional limitations of bunching of shade material and a hole in the coverage of the shade material as it bends out around the hinge. This hole is also aesthetically displeasing and requires some additional shade or ornamentation to disguise it.

Schnebly et al. (U.S. Pat. No. 5,002,112) (Schnebly II) provides additional embodiments for covering arched and arcuate windows. These consist of fixed fans of pleated or honeycomb material supported on fixed arcuate frames with finger-like extensions for engaging the pleats or honeycombs to supply the necessary arcuate splay and some minimal vertical support. These systems are static and must be manually placed within or removed from the window frame, thereby severely limiting their usefulness. As with Schnebly I, applications of these systems are limited to fairly rigid, pleated or honeycomb shade materials as other materials would not have the stiffness required to support their own weight in such fan-like configurations.

Judkins (U.S. Pat. No. 4,518,025) discloses a system for clamping the top edges of irregular shaped shades to the upper rail mounted in the lintel. Pitched and arched shades are particularly shown. This system does not, however, allow the shades to be entirely raised. Retraction is limited to portions covering rectangular areas only. When an irregular section is reached, the shade can be opened no further because either the bottom rail encounters the lintel on one side or it is unable to travel through the narrowing frame of an arched section.

Niemeijer et al. (U.S. Pat. No. 5,092,383) discloses shade mechanisms for covering rectangular windows with pitched or arcuate lintels. The invention uses pleated or honeycomb shade material as well and is concentrated on an intricate weaving system of drawstrings through the shade material and a guide system to continue to evenly raise the shade through the pitched and arcuate sections without binding once the rectangular window section is passed. A middle rail is used at the threshold between the rectangular and pitched or arcuate sections. The lower shade material stacks against the underside of the middle rail which is hinged on one end to the lower end of the upper rail along the lintel. The middle rail in a pitched embodiment travels to finally rest against the upper rail. Niemeijer also considers using flexible middle and bottom rails, e.g., made out of flexible plastic, to conform to arcuate lintels when the shades are drawn fully open. Problems with this invention are similar to those previously described: the shade material in the pitched or arcuate portion is not horizontal, but bunched and fanned; as the middle rail travels through the angle on its hinge, the shade material is subjected to tension, stress, and possible tearing due to the difference in width between the rectangular section and upper rail; and the shade material available is limited to rigid pleated or honeycomb structures. In the arcuate configuration utilizing flexible rails, the shade material is subject to even more tension and stress.

Wolf et al. (DE 4037264A1) similarly discloses a hinged middle rail system for covering a pitched top portion of an otherwise rectangular window. The invention is substantially similar to that of Niemeijer et al. and therefore shares its problems and limitations.

Schön (U.S. Pat. No. 5,197,526) (Schön I) discusses shades for shading triangular, trapezoidal, polygonal, or semicircular windows using pleated or gatherable shade material. In all of the various embodiments shown and discussed, the basic principal revealed is the use of guide cords running through the lateral edges of the shade material to keep it horizontally stretched across the window frame. Additional draw cords are used, spaced appropriately along the horizontal width, to raise or lower the shade. This solution is both practically limited and aesthetically unpleasing. The Schön I invention creates severe bunching of the shade material at the application points of the draw cords. Also inherent in the design, the lateral edges of the shade material drag behind and lower along the guide cords. The shades of this disclosure can never be fully and uniformly raised and they create great tension and stress on the shade material, potentially ripping or tearing it.

Schön et al. (EP 0058459) (Schön II) discloses a shade for use in a frame with a non-horizontal lintel. The top of the shade is trimmed diagonally and appears to be secured to the upper rail by a cord woven along the diagonal through openings in the edge of the shade material. Schön II states that this allows for freedom of movement along the top edge as the bottom rail is tilted while bringing the longer side of the shade against the upper rail. This cord system does not, however, prevent the bunching of shade material on one side nor reduce the stress on the shade material between the dual drawstrings running lengthwise through the material to the bottom rail. When the bottom rail begins to tilt, the formerly uniform distance between the draw cords progressively widens creating tension, stress, and potential tearing of the shade material in between.

Steiger (PCT/EP 92/00382) discloses a shade for triangular window segments composed of a shorter upper rail to which the top edge of the shade material is attached. The upper rail is raised and lowered via a cord system raising and lowering the shade similar to a boat sail. Guide cords threaded through openings on the lateral edges of the shade material keep the shade in the frame, guide cords along angled sides being tensioned to provide or remove slack as needed. Apparent limitations with this design include the inability to provide coverage at the apex of the window and the necessity for a separate shade or hinged middle rail as in Niemeijer to cover the lower rectangular portion of the window.

Scharfenberg (EP 0534261-A2) discloses a window shade for trapezoidal windows similarly incorporating a shorter top rail and tensioned lateral edge guide cords, as well as a tensioned cord along which the top rail manually travels to raise and lower the shade. Applications for this shade are limited to trapezoidal shapes; it is unable to operate in arched, triangular, or other pitched lintel situations.

Finally, Rupel et al. (U.S. Pat. No. 5,207,257) and Yamakawa (JP 404269919) each disclose a shade for a rectangular window frame using pleated shade material which by means of a separate drawstring collapses a hinged bottom rail upwards to create a decorative fan-shaped shade.

SUMMARY OF THE INVENTION

The present invention utilizes a unique new design for either the lower or upper rail on a window shade system called a sliding headrail. The sliding headrail allows a shade to be fitted exactly to a myriad of nonrectangular window shapes and to be opened or closed without placing undue stress upon the shade material or causing unsightly bunching of the shade material. In fact, the sliding headrail keeps shade material neat and flat within the window frame, and if pleated or honeycombed, maintains the pleats in their natural horizontal arrangement.

In one embodiment, the sliding headrail is composed of numerous sliding sections which allow the headrail to conform to the shape of most any nonrectangular window including pitches, peaks, triangles, trapezoids, arches, arcuate sections, or full or partial ellipses. Each section is composed of a thin, flat, rigid material, generally rectangular in shape. In the preferred embodiment, sections are connected to each other in an alternating overlapping/underlying manner by two pins or screws which are fixedly attached to a face of one section and glide in one or more slots in the opposing face of an adjacent section. Other means of attachment of the sections allowing both horizontal and vertical movement between the sections may be used as well.

Depending upon the shape of the window, the number and orientation of slots in the sliding headrail sections may vary.

Sliding headrail sections for windows with straight sills or lintels may have only one slot per pair of pins to allow for strictly horizontal movement, relative to the sections, along the sections. For windows which have some curvature, at least one slot is angled with respect to the horizontal, relative to the sections, to allow for vertical movement between sections, thus creating a curved headrail. In situations where both the upper and lower portions of a window are curved, at least one slot may be arcuate which allows the headrail to reverse its curvature to fit the appropriate side of the frame. At least two pins are preferred to maintain the structure between the sections as one pin might simply create a freely rotating hinge or pivot.

Shade material is attached to the sliding headrail segments at various points via a novel shade leveling rod. In one embodiment, an individual shade leveling rod is a length of wire fixedly attached at each end along a sliding headrail segment. The length of the shade leveling rod is displaced from the headrail segment. The shade material is attached via an eyelet running through the shade material at a fixed point and around the shade leveling rod. The eyelet is therefore free to travel the length of the shade leveling rod. Although this particular embodiment of a shade leveling rod has been disclosed, any similar sliding attachment would work equally as well. Additionally, in some circumstances as for narrow windows, or windows with lintels with mild angles of pitch or curvature, a single headrail segment may suffice to support the shade material attached to a shade leveling rod.

The shade leveling rods allow the shade material to remain horizontally level regardless of whether the shade is partially or fully open or closed. This benefit is especially apparent when the shade material used is pleated. The regular spacing of attachment points along the edge of the shade material reduces the stress due to drawing the shade open or closed placed upon any one point, ensures the appropriate distribution of the shade in the frame, and prevents drooping of lateral ends. The shade leveling rod also prevents the stress associated with drawing shade material into nonrectangular areas such as pitches, peaks, and arches.

In addition to attaching the shade material along its top edge to the headrail segments, the shade material may be additionally or alternately supported by support rods. Support rods may be easily placed at various levels of the shade, either external or internal, such as lengthwise within a chamber of honeycomb shade material and attached to the headrail segments by cords on the back side of the shade material. When the window shade is raised, the cord attached to the support rods become taught and pull the rods up which help to distributively support the shade material. When the shade is lowered, the rods help to compress the shade material in the sill and prevent the shade material from bunching.

Another technique for attaching shade material to a headrail in a single headrail application is to use a shade elevating rod. The shade elevating rod is preferably inserted into the top chamber of honeycomb fabric or into a seam along the top edge of other shade material to provide distributed support to the shade material. In arched lintel applications, the shade elevating rod may be slightly arched as well to provide a snug fit for the shade material against the lintel. In appropriate applications, multiple shade elevating rods may be used. A novel system for threading a draw cord to obscure its presence in the lintel and preventing it from becoming entangled in the headrail hardware is also disclosed.

The window shade is not limited to the use of any particular shade materials, and can use virtually any window covering material depending on the appropriateness of the application. With obvious modifications to the strength of components used in construction and an appropriate choice of shade material, the present invention can be conformed for exterior applications as well.

BRIEF DESCRIPTION OF THE DRAWINGS

FIG. 12*a* is rear view of the sliding headrail with a hinge plate for a peaked lintel application in a flat position.

DETAILED DESCRIPTION OF THE DRAWINGS

Figure 1A:
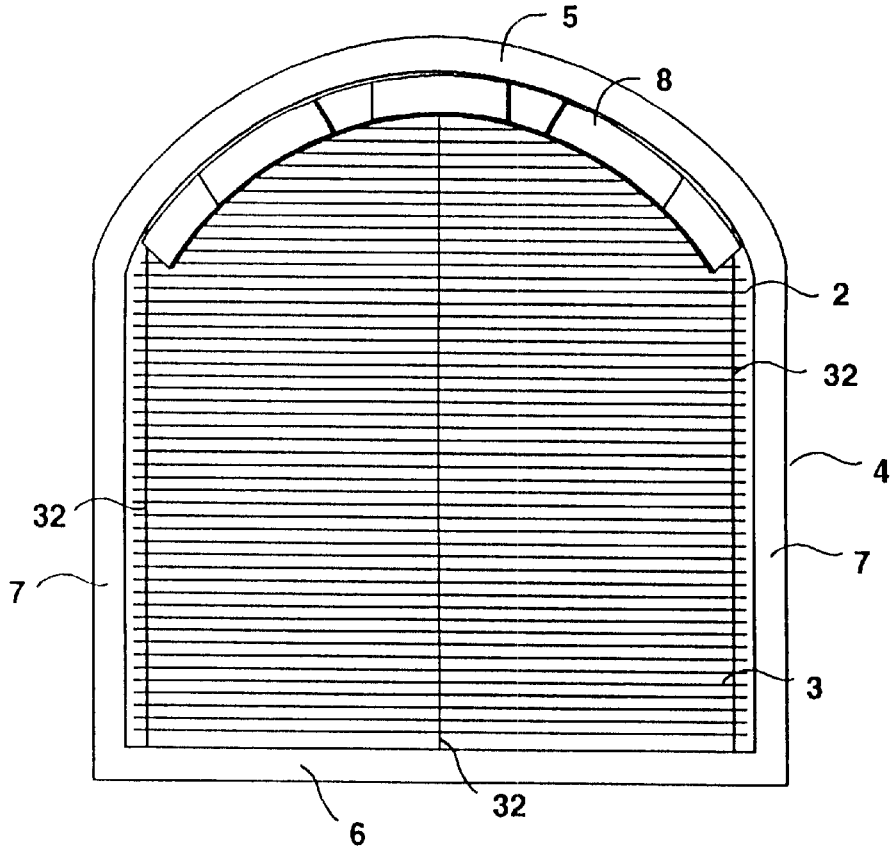
FIG. 1*a* is a front view of an arched embodiment of the present invention with the shade fully closed.
Figure 1B:
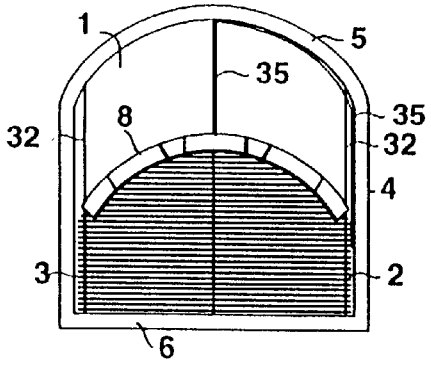
FIG. 1*b* is a front view of an arched embodiment of the present invention with the shade partially closed.
Figure 1C:
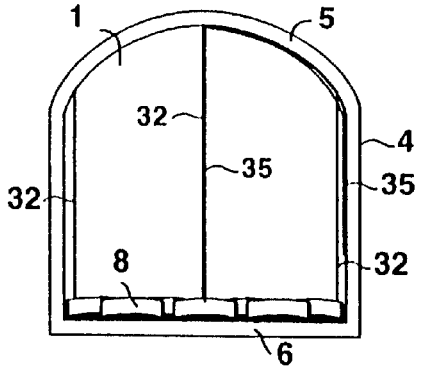
FIG. 1*c* is a front view of an arched embodiment of the present invention with the shade fully open.
Figure 2:
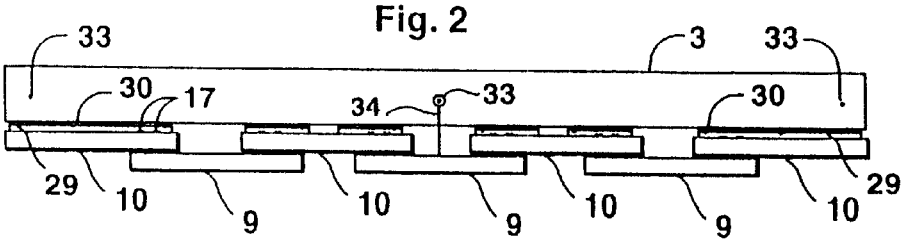
FIG. 2 is a top view of an arched embodiment of the present invention.

An arched embodiment of the present invention is displayed in FIG. 1*a* in a fully closed position. FIGS. 1*b* and 1*c* show the window shade 2 in partially open and fully open positions respectively. The sliding headrail 8 conforms to the shape of the lintel 5, supporting the shade material 3 to cover the window 1. The sliding headrail 8 is constructed by overlapping and underlying anterior headrail sections 9 and posterior headrail sections 10 respectively. In FIG. 2 this assembly can be seen more clearly from a top view. The headrail sections 9 and 10 can be constructed of most any suitably dense, rigid material such as wood, plastic, metal, resin, composite or other similar material.

Figure 3:
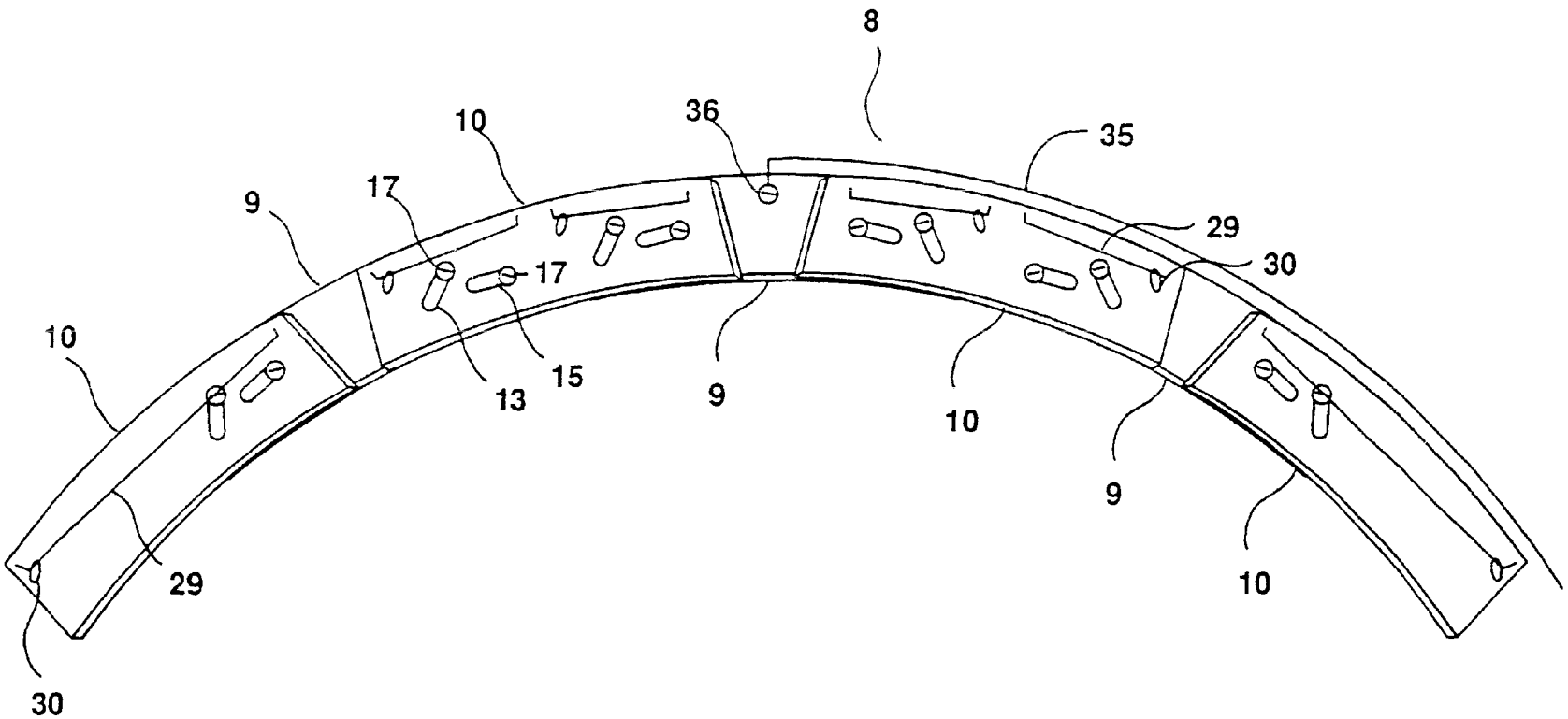
FIG. 3 is a rear view of an arched embodiment of the sliding headrail mechanism.
Figure 5:
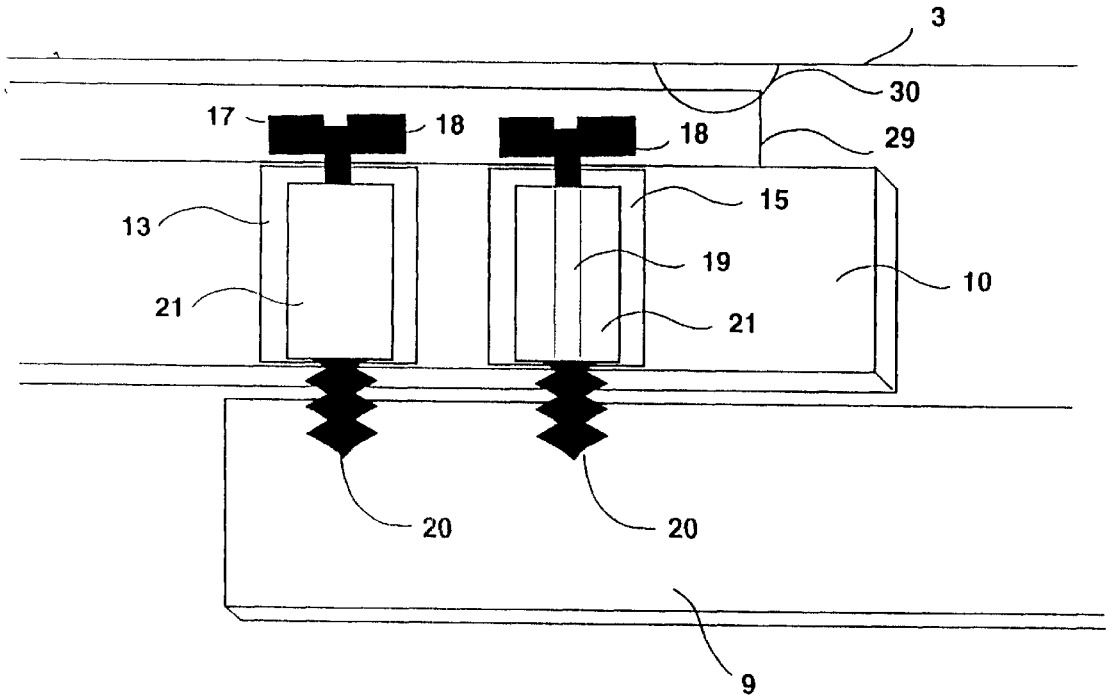
FIG. 5 is a cross section of the slots and pins in the joining the sliding headrail sections.

The anterior headrail sections 9 are joined to the posterior headrail sections 10 by means of slot pins 17 as seen in FIGS. 3 and 5. Slot pins 17 can be screws, nails, rivets or other similar fastening devices to allow for the necessary movement as described. Slot pins 17 are inserted through curvature slots 13 and an anti-rotation slots 15, respectively, on the posterior headrail sections 10. The slot pins 17 are fixedly attached to the back side of the anterior headrail sections 9, via screw threads 20 in the present embodiment. The heads 18 of the slot pins 17 have a greater diameter than the width of the curvature slots 13 and anti-rotation slots 15, thereby preventing separation of the anterior headrail sections 9 from the posterior headrail sections 10.

Figure 4A:
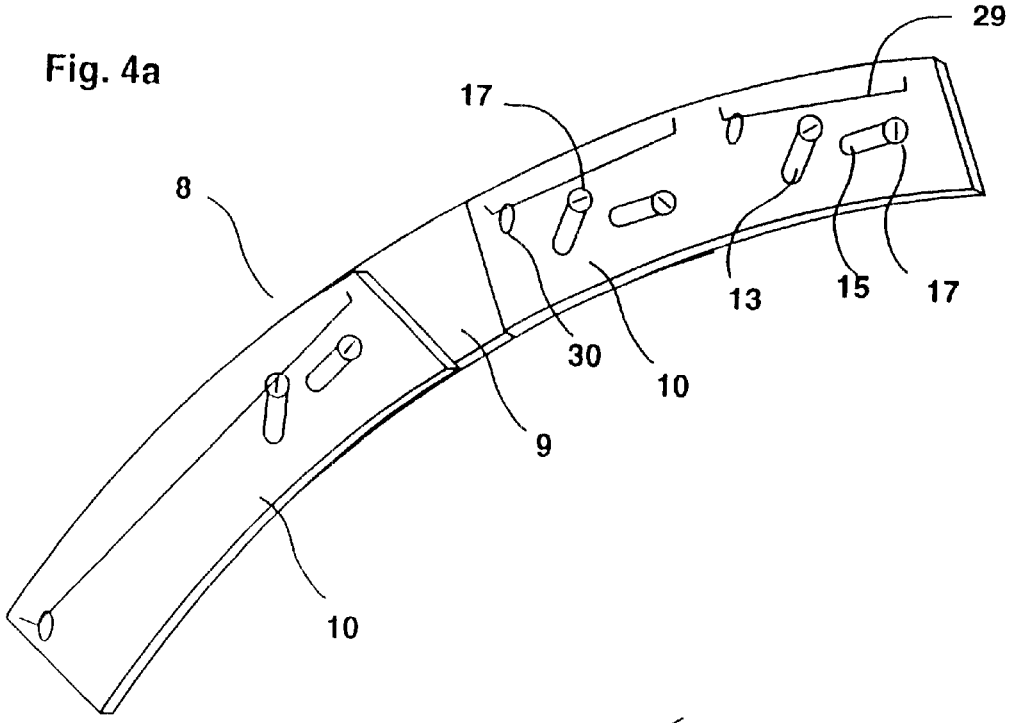
FIG. 4*a* is a partial view of headrail slots on the rear of the sliding headrail.
Figure 4B:
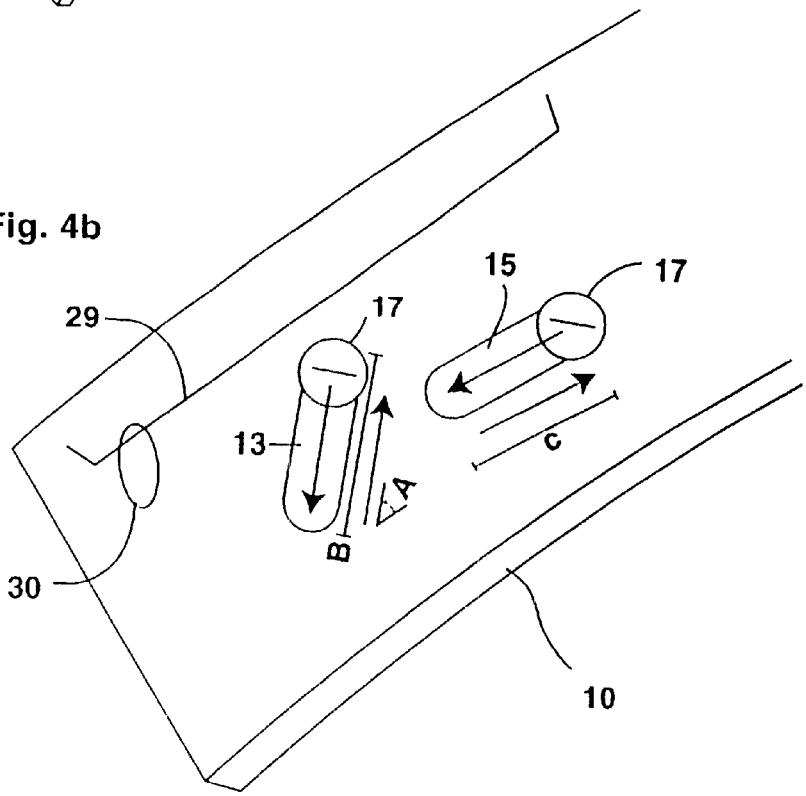
FIG. 4*b* is a more detailed partial view of headrail slots on the rear of the sliding headrail.

As depicted in the drawings, particularly in FIGS. 3, 4*a*, and 4*b*, the curvature slots 13 and the anti-rotation slots 15 are linear apertures in the posterior headrail sections 10. These slots could also merely be recessed with lateral channels to accept the head 18 of a slot pin 17, a plate with a slotted aperture covering the recess to restrain the head 18 of a slot pin 17, or other means of creating a channel for the head 18 of a slot pin 17 to travel. Other appropriate linear travel systems should be apparent to those skilled in the art.

Figure 8A:
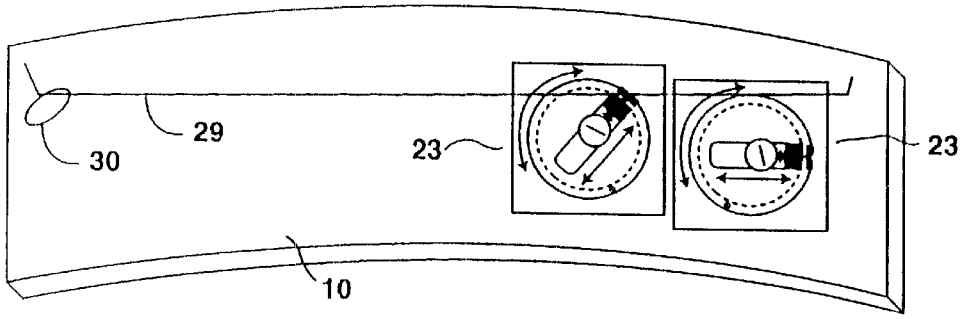
FIG. 8*a* is a rear view of a posterior headrail section with an adjustable curvature slot.
Figure 8B:
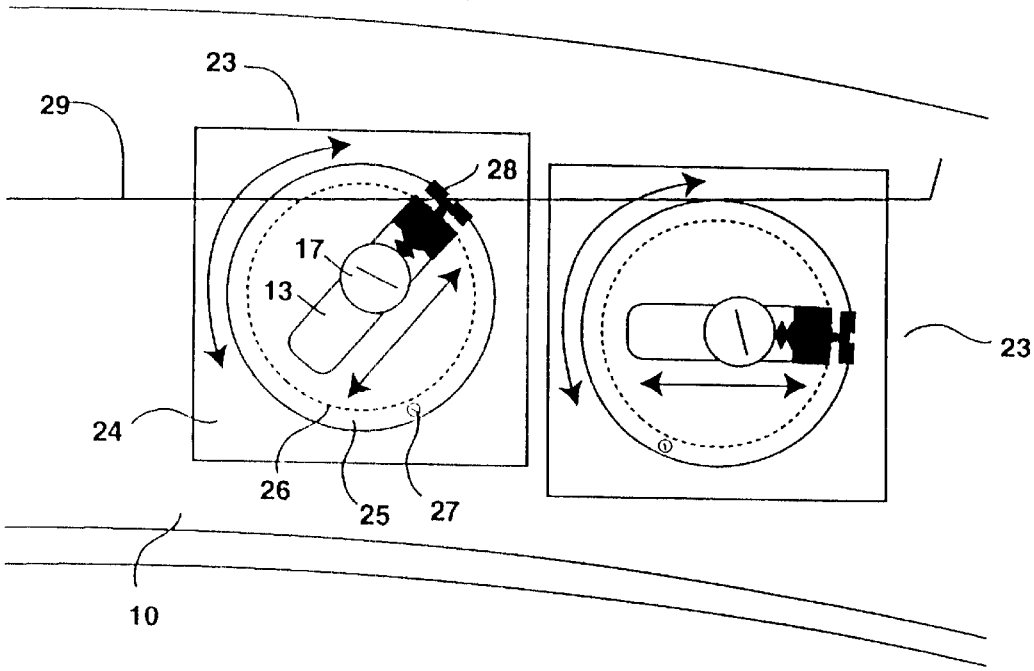
FIG. 8*b* is a detailed partial rear view of a posterior headrail section with an adjustable curvature slot.

One novel system for an adjustable curvature slot 23 is disclosed in FIGS. 8*a* and 8*b*. In this embodiment a large diameter bore hole 26 is made in the posterior headrail section 10, the diameter of which is equal to the maximum travel length of a curvature slot 13 for a specific range of window lintel 5 curvatures. A stationary plate 24 is fixedly attached to the back face of the posterior headrail section 10, centered over the bore hole 26. Inset into the stationary plate 24 is a circular rotating plate 25 which may freely rotate in the stationary plate 24. The rotating plate 25 contains an aperture which is the curvature slot 13. A locking screw 27 on the outer edge of the rotating plate 25 may be tightened against the backside of the posterior headrail section 10 to prevent rotation of the rotating plate 25, thereby fixing the angle A of the curvature slot 13.

The maximum length B of the curvature slot 13 is the same as the diameter of the bore hole 26 and the curvature slot 13 is centered over the bore hole 26 such that as the rotating plate 25 is rotated, the lateral ends of the curvature slot 13 coincide with the circumference of the bore hole 26. The length B curvature slot 13 may be decreased by turning a slot adjustment screw 28, its shaft thereby extending into the curvature slot 13 and decreasing the available travel distance. This novel adjustable curvature slot 23 provides the ability to fit multiple window curvatures without necessity of custom manufacture or provide quick adjustment to account for any irregularities when installing the window shade 2 in the field.

In addition to connecting the anterior headrail sections 9 to the posterior headrail sections 10, the slot pins 17 also slide within and along the length of the curvature slots 13 and the anti-rotation slots 15. This sliding ability allows the sliding headrail 8 to conform to the flat sill 6 of the window frame 4 when the window shade 2 is fully retracted, and also to conform to the arched lintel 5 when the window shade 2 is fully closed. To further facilitate travel within and along the curvature slots 13 and anti-rotation slots 15, a pin bushing 21 is placed around the shafts 19 of the slot pins 17 as shown in FIG. 5. The pin bushing 21 may be any appropriate bearing bushing (needle, roller, ball, etc.) which will reduce any sliding friction between a slot pin 17 shaft 19 and a curvature slot 13 or an anti-rotation slot 15.

FIG. 4*b* shows the curvature slot 13 formed at an angle A from the horizontal respective to the length of a posterior headrail section 10. One way to approximate angle A, within tolerances appropriate to this application, is to use the acute angle formed between a tangent to the arch and a horizontal plane running through the arch at the point of intersection between the arch and a vertical plane running through the resting location of the slot pin 17 in the curvature slot 13 when the sliding headrail 8 rests on the sill 6. An appropriate length B of the curvature slot 13 may be approximated by subtracting the length of the sill 6 from the arc length of the arched lintel 5 and dividing the difference by the number of headrail sections 9 and 10 less one, which is the number of curvature slots 13 in a sliding headrail 8. This allows the curvature slots 13 to expand the sliding headrail 8 from the length of the sill 6 to the arc length of the arched lintel 5. The length B of the curvature slots 13 controls the ability of the sliding headrail to expand and rotate to fit the arch of the lintel 5, as well as collapse and rotate to fit a horizontal sill 6.

Figure 7:
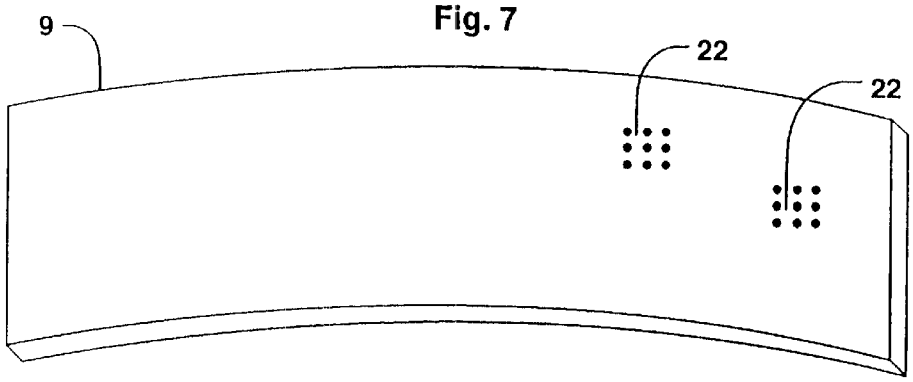
FIG. 7 is a rear view of an anterior headrail section with pre-drilled guide holes.

The anti-rotation slot 15 is long enough to allow the slot pin 17 in the tandem curvature slot 13 to travel the length B of the curvature slot 13. The length C of the anti-rotation slot 15 therefore is simply the cosine of angle A multiplied by the length B of the curvature slot 13. In certain applications, it may be appropriate to reduce the anti-rotation slot 15 to merely a pivot point. Due to irregularities in construction of windows 1 and window frames 4, it may be easier to manually fit the headrail sections 9 and 10 to the arcuate surface of the window frame 4 and manually create the curvature slot 13 angles A and lengths B, rather than compute the approximate the trigonometry as described above. Manual adjustments can also be facilitated by pre-drilling a grid of numerous guide holes 22 in the back of the anterior headrail sections 9, as shown in FIG. 7, thereby providing multiple attachment points for the slot pins 17.

The anti-rotation slots 15 are used to maintain the horizontal integrity of the sliding headrail 8. Without the anti-rotation slots 15, the slot pins 17 in the curvature slots 13 may act as freely rotating hinges, allowing the headrail sections 9 and 10 to dangle freely from each other. Other means of providing vertical and horizontal movement between headrail sections 9 and 10, without creating a freely rotating pivot, may be substituted. Each anti-rotation slot 15 is placed so that its baseline is parallel to the plane of the horizontal width of the headrail section 9 or 10.

The curvature slots 13 and the anti-rotation slots 15 may be placed in either the anterior headrail sections 9 or the posterior headrail sections 10, or both. For aesthetics, in the described embodiment the slots 13 and 15 are placed only in the posterior headrail sections 10 to create a clean surface on the front of the sliding headrail 8. Additionally, the top edges 11 of the headrail sections 9 and 10 may be planed, carved, cast, molded, or otherwise tooled to conform the sliding headrail 8 to the curvature of the arched lintel 5, creating a more form fitting and aesthetically pleasing window shade 2.

Figure 6A:
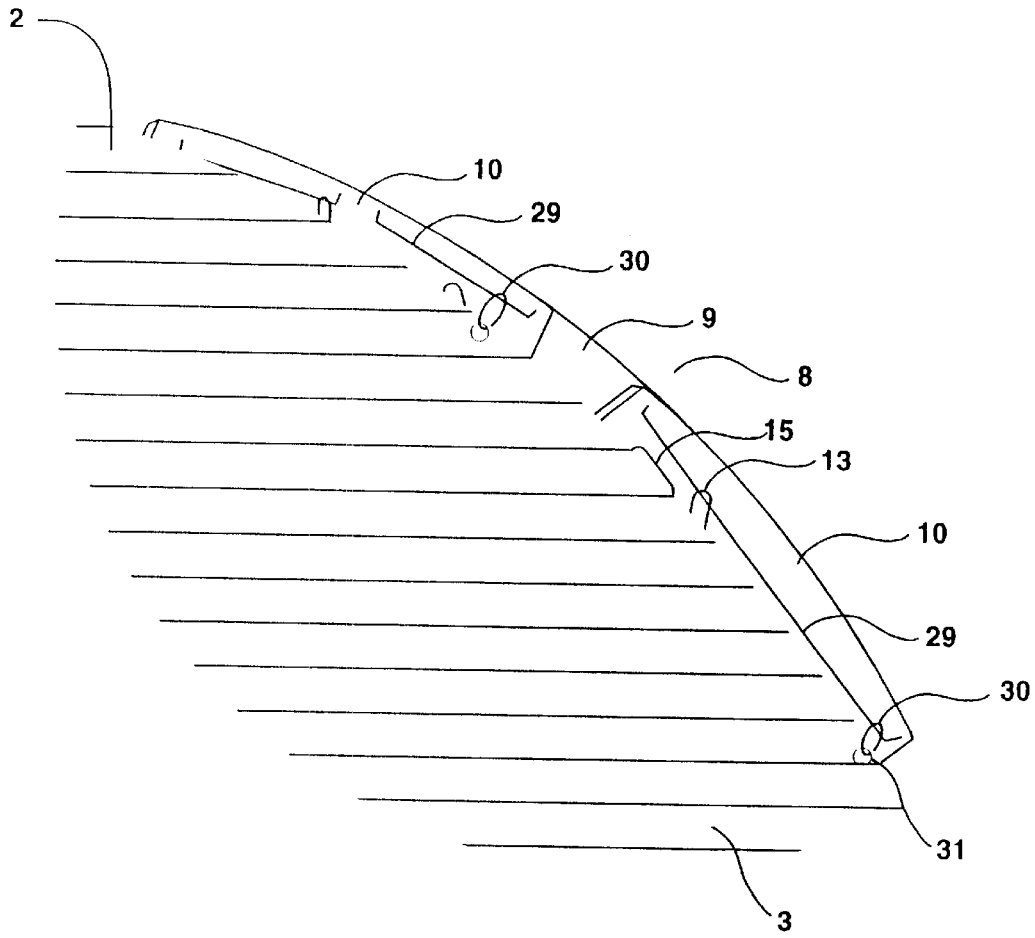
FIG. 6*a* is a partial view of the attachment of blind material to the sliding headrail in an arched embodiment.
Figure 6B:
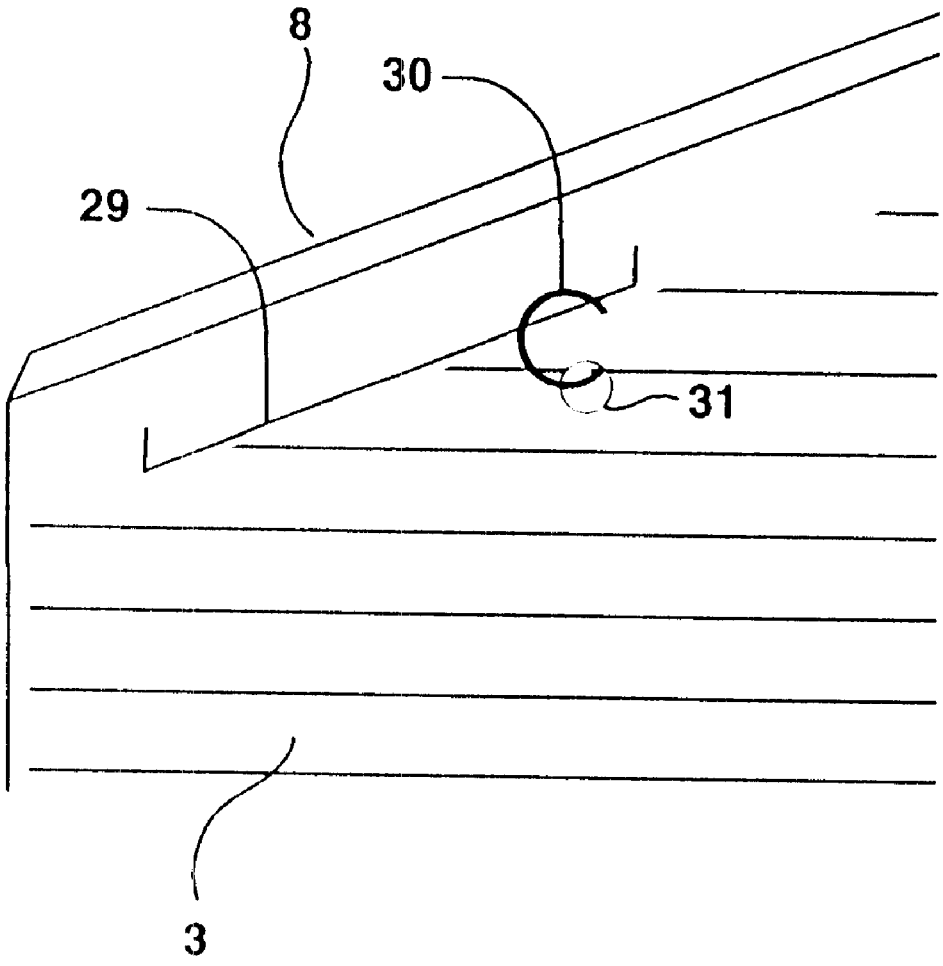
FIG. 6*b* is a partial view of the attachment of blind material to the sliding headrail in a pitched embodiment.

The bottom edge of the shade material 3 is fixedly attached to the sill 6 and along its upper edge the shade material 3 is attached to the sliding headrail 8 via novel shade leveling rods 29 as shown in FIGS. 6*a* and 6*b*. Initially, the upper edge of the shade material 3 is cut or trimmed to fit the shape and curvature of the arched lintel 5. The upper edge of the shade material is then perforated at various points to create eyelet attachment holes 31. The eyelet attachment holes 31 are generally placed at regular intervals along the upper edge of the shade material 3 to distribute the stress placed on the hanging shade material 3. The eyelet attachment holes 31 can additionally be reinforced to further resist the stress placed on each eyelet attachment hole 31. Eyelets 30 are inserted through each eyelet attachment hole 31 and are additionally secured around a corresponding shade leveling rod 29.

The shade leveling rods 29 are fixedly attached to the sliding headrail 8 in counterpart to the location of each eyelet attachment hole 31 in the shade material 3. Each shade leveling rod 29 is of a length long enough to allow the sliding headrail 8 to expand to the length of the arched lintel 5 and contract to the length of the horizontal sill 6, without creating additional stress on the shade material 3. This is accomplished because the eyelet 30 may freely travel along the length of the shade leveling rod 29 as the sliding headrail 8 expands and contracts. Rather than using separate eyelets 30, in some applications it may be preferable to attach the shade material 3 directly to the shade leveling rods 29 via the eyelet attachment holes 31.

The shade leveling rods 29 may be constructed of taught wire, plastic, thin metallic rods, or other similar thin-gauge, rigid, tensilely strong material which will not sag. The shade leveling rods 29 may be mounted on the back of the sliding headrail 29, in this embodiment on the backs of the posterior headrail sections 10, minimally displaced from, rather than flush with, the back surface of the posterior headrail sections 10 to ensure unimpeded travel of the eyelets 30 along the shade leveling rods 29. Other means of attaching the shade material 3 to the sliding headrail 8 which allow for horizontal movement in the positioning of the shade material 3 relative to the sliding headrail 8 may be used as well.

Not only do the shade leveling rods 29 reduce the stress placed upon the shade material 3, they also allow the shade material 3 to remain horizontally centered in the window frame 4. In applications where the shade material 3 is pleated, honeycomb, blinds, or similar material with horizontal pleats or sections, the combination of the sliding headrail 8 and the shade leveling rods 29 maintain the integrity and visual aesthetic of the horizontal attributes of the shade material 3. The present invention thereby avoids the need to fan or bunch shade material 3 to cover the window 1 and additionally prevents fanning or drooping of the lateral edges of the shade material 3 by providing regular support of the upper edge of the shade material 3 with the shade leveling rods 29. In fact the present invention provides support for the shade material 3 over a width nearly as wide as the window 1 itself, allowing for few size restrictions in its application. Another benefit is there is no limitation upon the type of shade materials 3 which can be used. In addition to pleated and honeycomb materials, regular drapery fabric, wood blinds, mini-blinds, roman shades, and other materials may easily be used.

This novel combination of the sliding headrail 8 and shade leveling rods 29 also provides full coverage of the window 1 within the window frame 4 when drawn closed and full retraction when drawn open in one window shade 2, rather than merely partial coverage or the necessity of installation of multiple shades and the utilization of variously fanned and bunched pleated shade material 3 to cover the variously shaped sections of the window 1. In the preferred embodiment, the window shade 2 operates in a "bottom gathering" fashion, wherein the shade material 3 gathers behind the sliding headrail 8 at the sill 6 of the window frame 4 when the window shade 2 is opened. This bottom gathering feature preserves the aesthetic of the arched lintel 5 when the window shade 2 is open and hides the gathered shade material 3 behind the sliding headrail 8 which acts like a valance. Similarly, when the window shade 2 is drawn closed the sliding headrail 8 appears as a valance along the lintel 5 of the window frame 4.

It should be readily apparent, however, that the present invention can be installed in a "top gathering" fashion as well. A top gathering application may preferably use a more resilient shade material 3, such as pleated or honeycomb material, in order to conform to the arch of the lintel 5 when drawn open and still maintain its horizontal integrity without additional fold marks when drawn closed. It should also be readily apparent that the headrail segments may be attached either in front of or behind the shade material depending upon the aesthetic desired by the user.

The window shade 2 is drawn open and closed via a draw cord 35 as shown in FIGS. 1*b* and 1*c*. In the pictured embodiment only a single draw cord 35 is used and it is fixedly attached to the center of the sliding headrail 8 by a draw cord pin 36. The draw cord pin 36 may be a screw, nail, rivet, or other suitable means for attaching a draw cord 35 to the sliding headrail 8. The draw cord 35 is preferably drawn through a series of pulleys or similar mechanisms widely known and used in the window shade trade, to route the draw cord 35 within the window frame 4 to provide a user easy access to the end of the draw cord 35 to raise and lower the window shade 2. The user end of the draw cord may be appended with a tassel 50 for ease of grasping by the user. The draw cord 35 may additionally be operated via the use of any of numerous commercially available motorized blind operators which have a variety of features such as remote control or automatic timing systems.

One of the pulley positions is preferably in the center of the lintel 5 to allow the sliding headrail 8 to be raised and lowered at its horizontal center, thereby maintaining the balance of the sliding headrail 8 and the horizontal center of the window shade 2 within the window frame 4. Depending upon the dimensions of the window, additional draw cords 35 may be utilized, attached at various intervals along the sliding headrail 8 to facilitate the raising and lower of the window shade 2 and reduce the stress placed upon a single draw cord 35 or a single point on the sliding headrail 8.

In addition, guide wires 32 may be used to ensure the window shade remains centered in the window frame 4. As seen in FIGS. 1*a* and 2, the shade material 3 is additionally perforated with guide wire holes 33 vertically in folds along its center and lateral edges to accommodate the threading of guide wires 32 through it. The guide wires 32 are fixedly attached to the lintel 5 and sill 6 to maintain a taught orientation within the plane of the window frame. The shade material 3 slides along the guide wires 32 as the window shade 2 is raised and lowered, ensuring the window shade 2 remains centered in the window frame 4. Draw cords 35 and guide wires 32 may be made of a variety of materials including metal wire, cord, monofilament—transparent or opaque—depending on the preference of the user. The guide wires 32 could additionally be rigid rods. The sliding headrail 8 may additionally have one or more guide wire guides 34 fixedly attached to it, through which the guide wires 32 are additionally threaded. Such guide wire guides 34 may help prevent the sliding headrail 8 from tipping out of the plane of the window frame 4 especially when resting on the sill 6. Additionally, a false sill box might be installed, similar to a planter box, to enclose the sliding headrail 8 and gathered shade material 3 when resting on the sill 6 to prevent tipping.

Figure 10A:
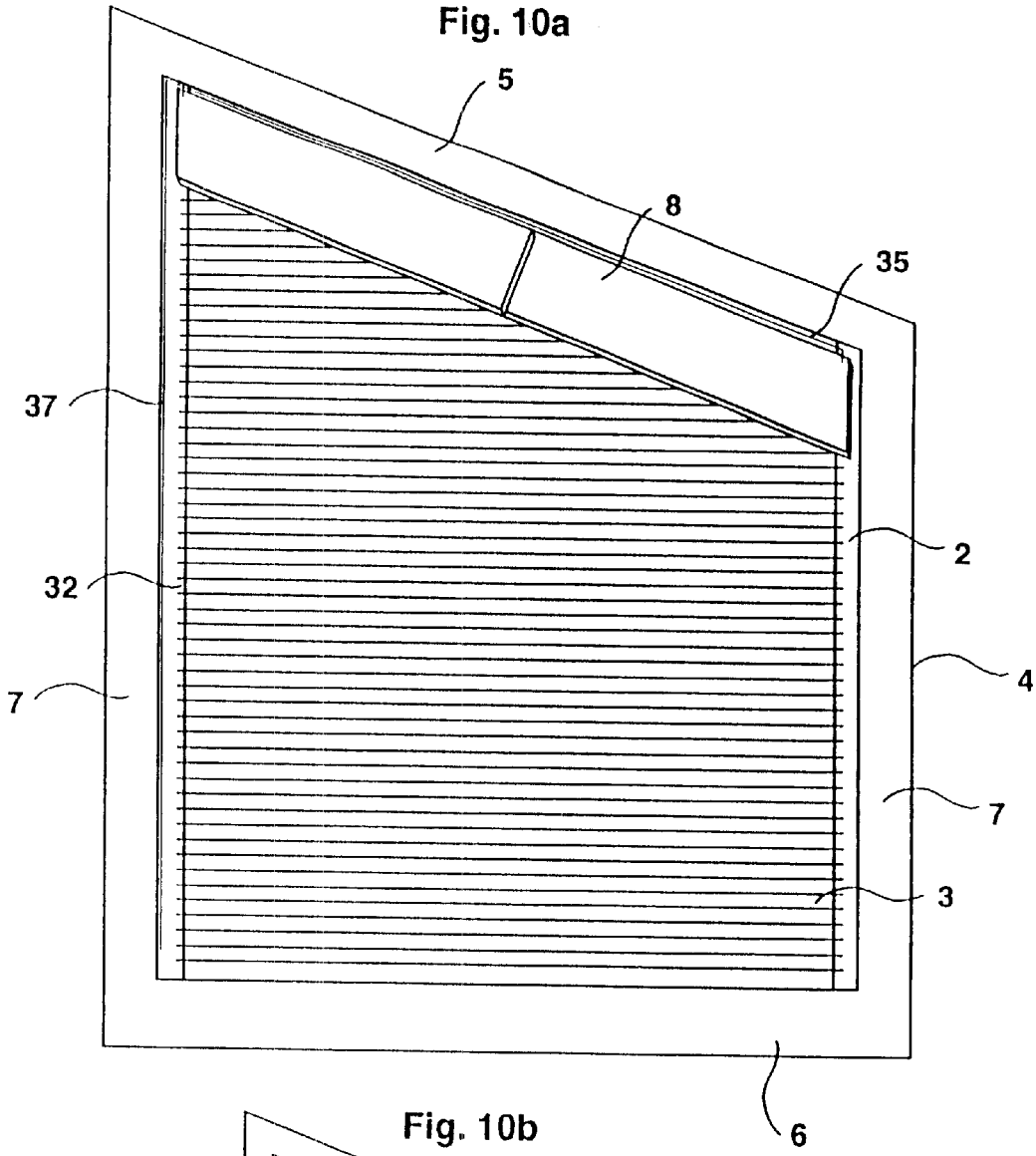
FIG. 10*a* is a front view of a trapezoidal embodiment of the present invention for use with a pitch lintel with the shade fully closed.
Figure 10B:
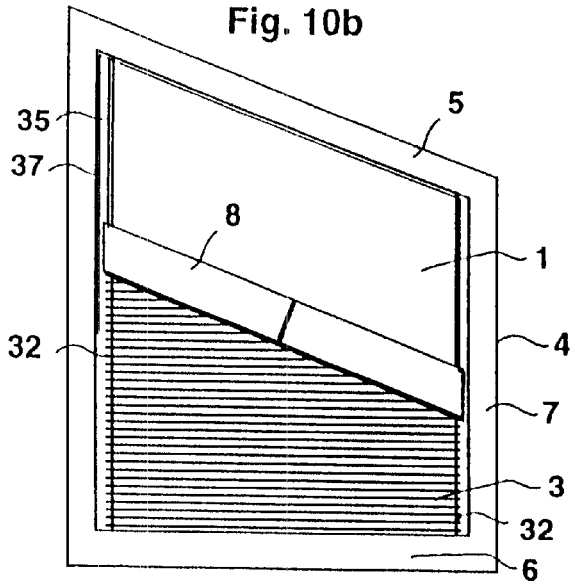
FIG. 10*b* is a front view of a trapezoidal embodiment of the present invention for use with a pitch lintel with the shade partially closed.
Figure 10C:
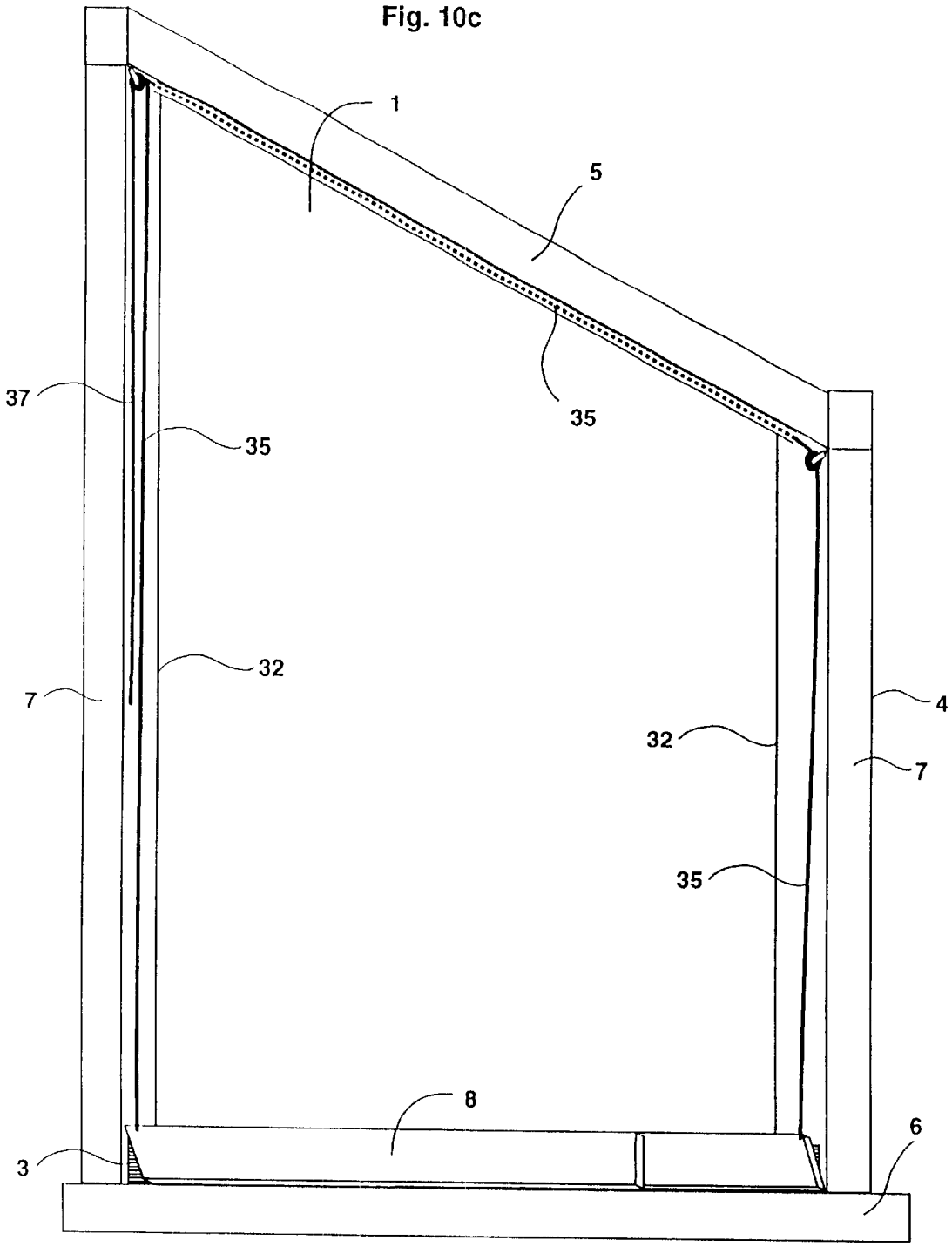
FIG. 10*c* is a front view of a trapezoidal embodiment of the present invention for use with a pitch lintel with the shade fully open.

FIGS. 10*a*, 10*b*, and 10*c* disclose a second embodiment of the present invention for application in windows with pitched lintels. The sliding headrail 8 may generally be constructed of fewer sections for this application. Only two sections are depicted in FIGS. 10*a*, 10*b*, and 10*c*, however more may be useful in application in extremely wide windows. The sliding headrail 8 is composed of essentially the same components as in the arched window application. It generally operates in a bottom gathering fashion wherein the shade material 3 is fixedly attached to the sill 6 and is attached to the sliding headrail 8 via eyelets 30 and shade leveling rods 29. Shade leveling rods 29 in this embodiment are attached to the anterior headrail section 9 as well as the posterior headrail section 10 as in FIGS. 6*b* and 11. Guide wires 32 fixedly attached to the lintel 5 and sill 6 and threaded through perforated guide wire holes 33 in the lateral edges of the shade material 3 may be employed as well to ensure proper positioning in the window frame 4.

Figure 11:
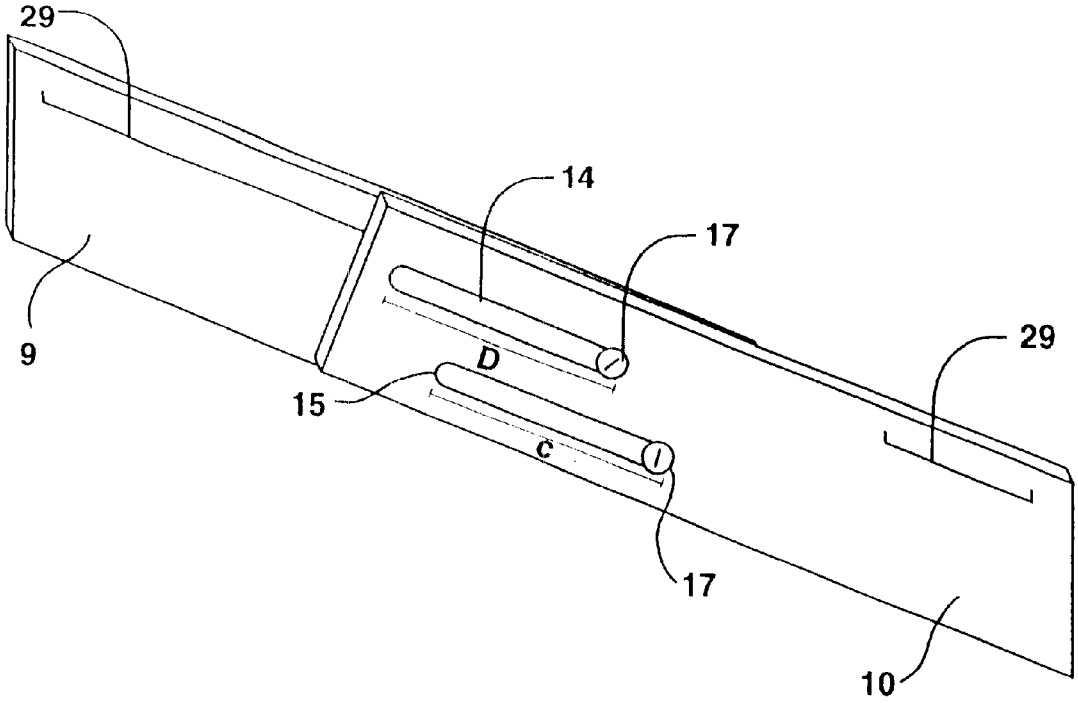
FIG. 11 is a rear view of the sliding headrail mechanism in a trapezoidal embodiment.

The major difference in construction of the sliding headrail 8 in the pitched lintel application is that travel slots 14 are used in place of curvature slots 13 as seen in FIG. 11. Rather than being angled with reference to the horizontal length of the posterior headrail section 10, the travel slot 14 is parallel to that same horizontal plane. The length D of the travel slot 14 is the difference between the length of the lintel 5 and the sill 6, thereby allowing the sliding headrail 8 to expand and contract to fill the width of the window frame 4 whether adjacent to the lintel 5 or sill 6. If more than two sections for the sliding headrail 8 are used,.then the lengths of the travel slots 14 should each be the difference between the length of the lintel 5 and the sill 6, divided by the number of headrail sections 9 and 10 less one. An anti-rotation slot 15, adjacent and parallel to the travel slot 14, is still preferred to maintain horizontal rigidity and prevent the travel slot 14 from becoming a freely rotating pivot or hinge. The length C of the anti-rotation slot 15 is the same as length D of the travel slot 14 to allow for the expansion and contraction of the sliding headrail 8.

Figure 15A:
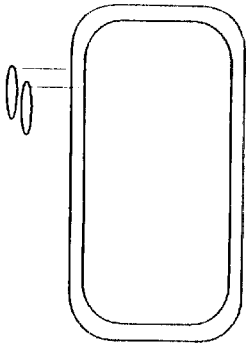
FIG. 15*a* is a side view of a telescoping sliding headrail.
Figure 15B:
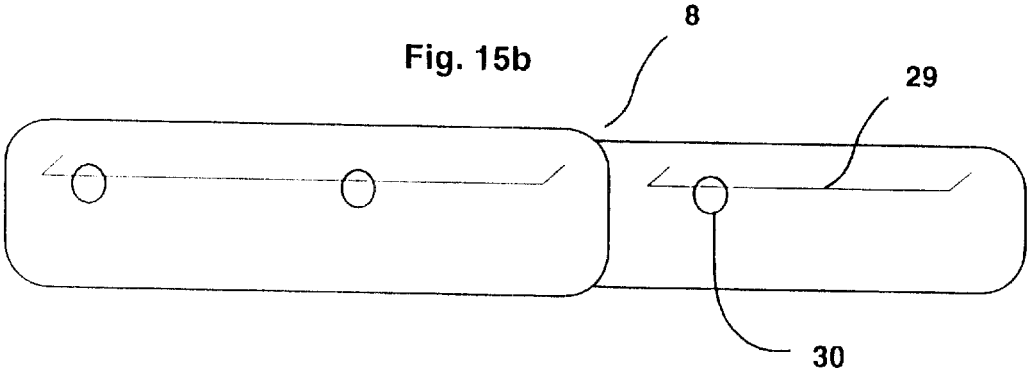
FIG. 15*b* is a front view of a telescoping sliding headrail.
Figure 15C:
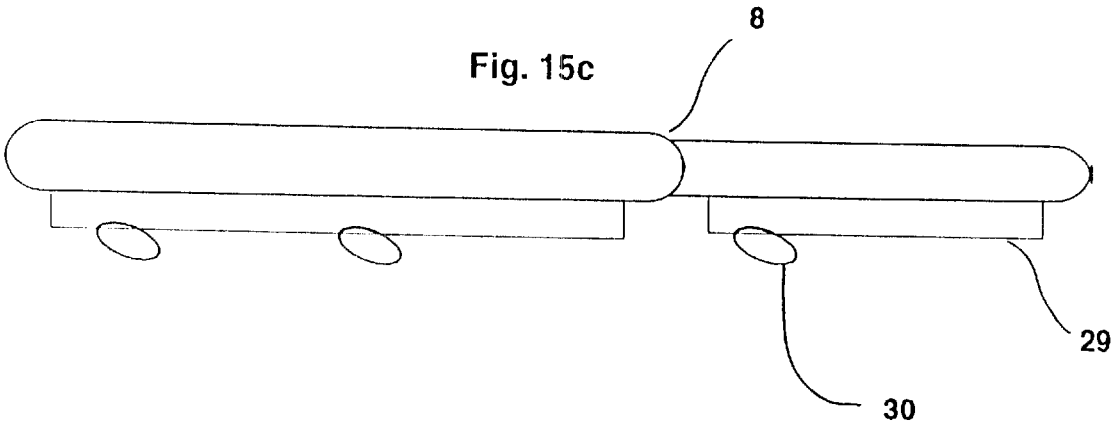
FIG. 15*c* is a top view of a telescoping sliding headrail.

Due to the linear nature of the travel between the headrail sections 9 and 10 in this embodiment, it should be apparent that a telescoping system may be substituted to achieve the same results as shown in FIGS. 15*a*, 15*b*, and 15*c*. Any appropriate tubular or channeled materials capable of nesting together can be substituted for the use of the travel slots 14 and anti-rotation slots 15.

The window shade 2 in the pitched lintel application will generally utilize two draw cords 35, each attached to a lateral end 12 of the sliding headrail 8 as depicted in FIG. 10*c*. The draw cords 35 may be connected to each other via a cord connector 48, as in FIG. 10*d* to provide the user with simply a single pull cord 37 to operate the window shade 2. Since the vertical travel distance of one lateral end 12 of the sliding headrail 8 is longer than the other lateral end 12, the lengths of the respective draw cords 35 may be appropriately adjusted to provide for even raising and lowering of the window shade 2. Several options to achieve this are well known in the art, including leaving slack in one draw cord 35, incorporating an elastic section into one of the draw cords 35 to compensate for the additional travel distance of the second draw cord 35, or using a system of spring loaded pulleys through which a draw cord 35 is threaded and which take up slack under tension. If slack is left in one draw cord 35, a cord stop 49 may be placed on the user end of this draw cord 35 such that when attached lateral end 12 of the sliding headrail 8 just reaches the sill 6, the cord stop 49 reaches the lintel 5 and prevents further lowering of the draw cord 35 attached to that lateral end 12 of the sliding headrail 8.

Another method is to join the ends of the draw cords 35 around a pulley wheel which is connected to the pull cord 37. In this manner, when the movement of the draw cord 35 with the shorter travel distance is arrested by the sliding headrail 8 reaching the lintel 5, the pulley wheel will allow the draw cord 35 with the greater travel distance to continue to be drawn by the pull cord 37. A further method is the use of a tension spring retraction device which plays out excess draw cord 35 once the lateral end 12 with the shorter travel distance is raised, and coils the slack in the draw cord 35 as this same end is lowered toward the sill 6.

Figure 10D:
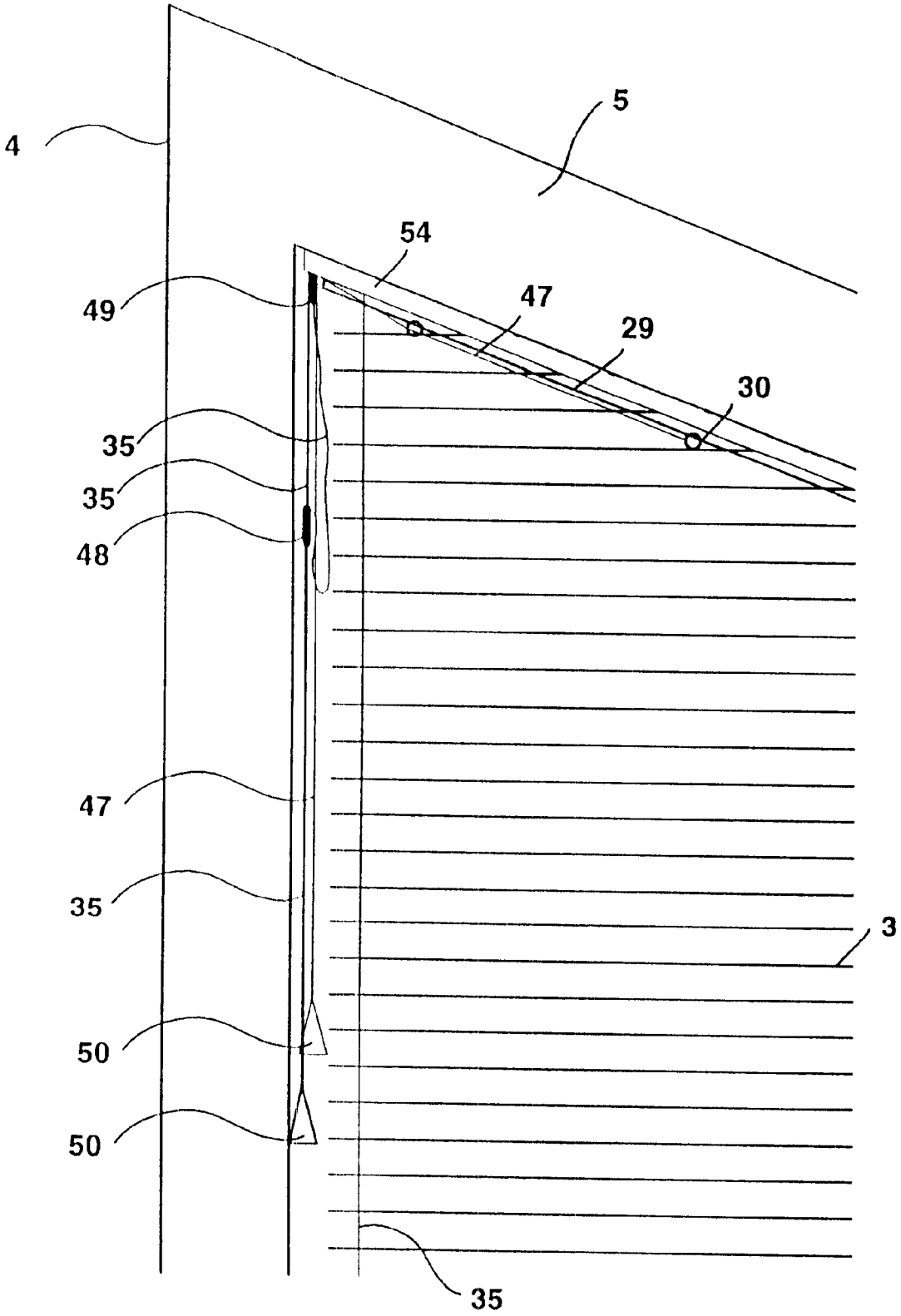
FIG. 10*d* is a front view of a trapezoidal embodiment of the present invention detailing a lintel mounted shade leveling rod, a cord connector, a cord stop, and a shade centering cord.

In a pitched lintel application with a high degree of slope or of very long width, the shade material 3 may tend to slide toward the lower side of the lintel 5 along the shade leveling rod 29 due to the weight of the shade material 3 or the significant slope. This may occur even if guide wires 32 are used. A solution to this problem, as shown in FIG. 10*d* is to attach a shade centering cord 47 to the eyelets 30 along the shade leveling rod 29. The shade centering cord 47 is routed to the higher side of the lintel 5 and down the side of the window frame 4 for easy access by a user. A user may simply pull the shade centering cord 47 which pulls the eyelets 30 along the shade leveling rod 29 toward the peak of the lintel 5, thereby centering the shade material 3 in the window 1. The shade centering cord 47 is then locked in place via a standard cord engagement mechanism, tying the cord to a cleat mounted in the window frame, or through any other well known manner.

Similar to the arched lintel application, the pitched lintel window shade 2 maintains the horizontal integrity of the shade material 3 and prevents any bunching or fanning of pleated or honeycomb materials. Unlike the arched lintel application, there is no limitation on the type of shade materials 3 which may be used in a top gathering application in a pitched lintel. For aesthetic purposes, the lateral ends 12 of the sliding headrail 8 may additionally be trimmed to parallel the lateral sides 7 of the window frame 4 when the window shade 2 is raised toward the pitched lintel 5 and the sliding headrail 8 expands. See FIG. 10*b*.

Figure 12A:
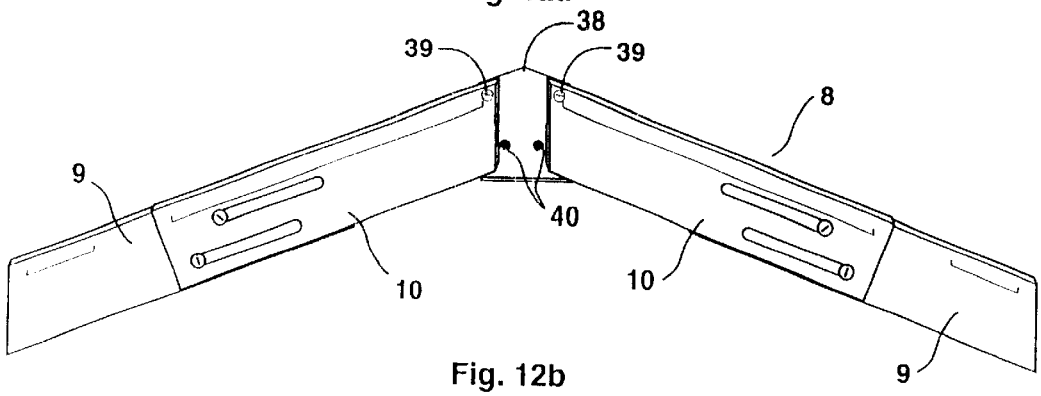
FIG. 12*a* is rear view of the sliding headrail with a hinge plate for a peaked lintel application in a peaked position.
Figure 12B:
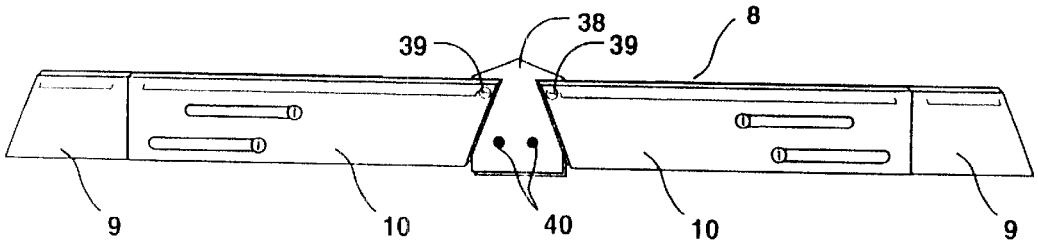
FIG. 12*c* is top view of the sliding headrail with a hinge plate for a peaked lintel application.
Figure 12C:
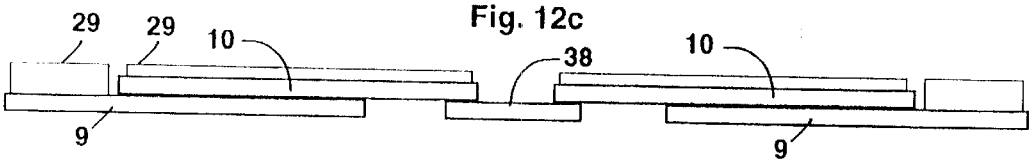

The pitched lintel embodiment of the sliding headrail 8 may be modified to accommodate peaked and triangular windows as shown in FIGS. 12*a*, 12*b*, and 12*c*. This is accomplished by inserting a hinge plate 38 between posterior headrail sections 10. The interior ends of the posterior headrail sections 10 are each attached to the hinge plate 38 via limited pivot hinges 39, respectively. The limited pivot hinges 39 allow the posterior headrail sections 10 to rotate downward but prevent any rotation upward beyond the horizontal. Downward rotation is stopped by means of hinge stops 40 which cause the posterior headrail sections 10 to halt their rotation at an angle conforming to the pitch of the peaked sides of the lintel 5. The top of the hinge plate 38 may be contoured such that it too fits the peak of the lintel 5.

Figure 9:
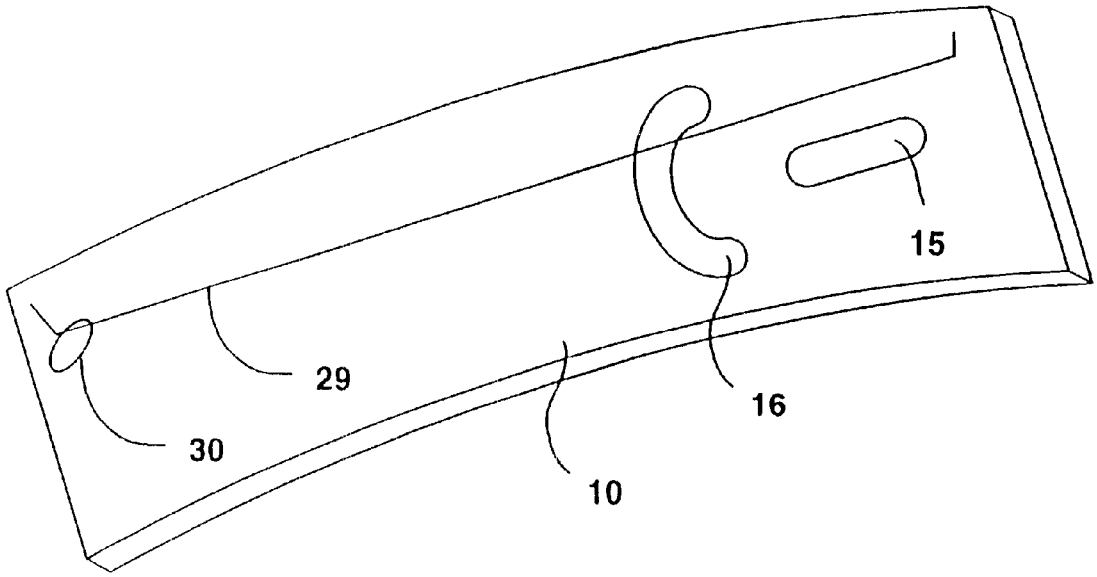
FIG. 9 is a rear view of a posterior headrail section with an arcuate curvature slot.
Figure 13:
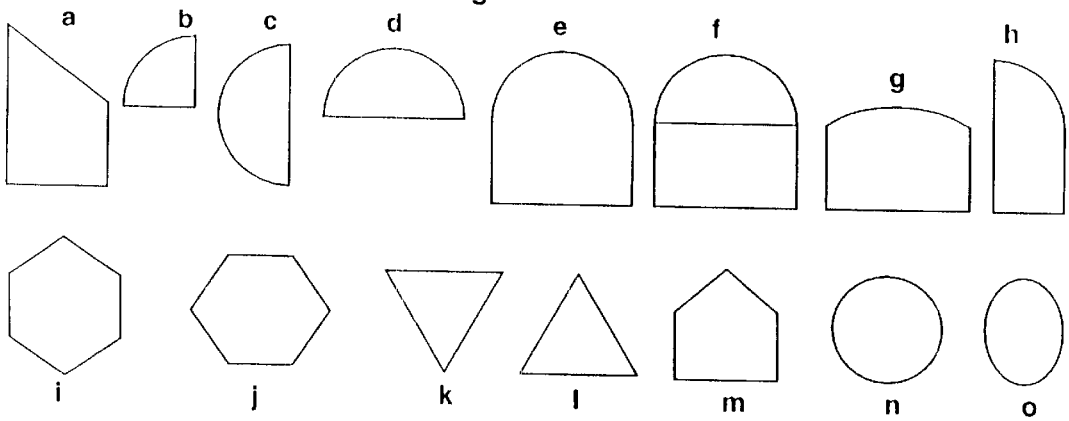
FIGS. 13*a–p* are various window shapes for which the present invention can be adapted to provide operable window shades.

FIG. 13 is a collection of window shapes to which the present invention may be easily adapted to provide window shades 2. These adaptations should be obvious to those skilled in the art after review of the embodiments of the invention disclosed herein. Specifically referring to FIGS. 13*c*, 13*n*, and 13*o*, the curvature slots 13 in the posterior headrails 10 may be arcuate slots 16, as shown in FIG. 9, to allow for a reversal of the arched configuration of the sliding headrail 8. Additionally, in reference to FIGS. 13*i* and 13*j*, the limited hinges 39 of hinge plate 38 may be reversibly limited to allow the sliding headrail 8 to conform to both a peaked lintel and a peaked sill.

Figure 14A:
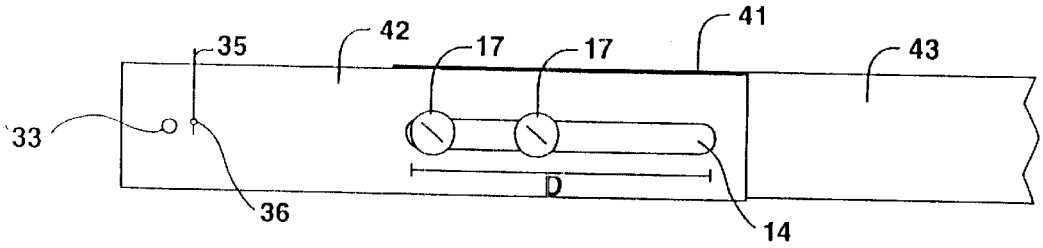
FIG. 14*a* is a partial top view of a horizontal sliding headrail embodiment.
Figure 14B:
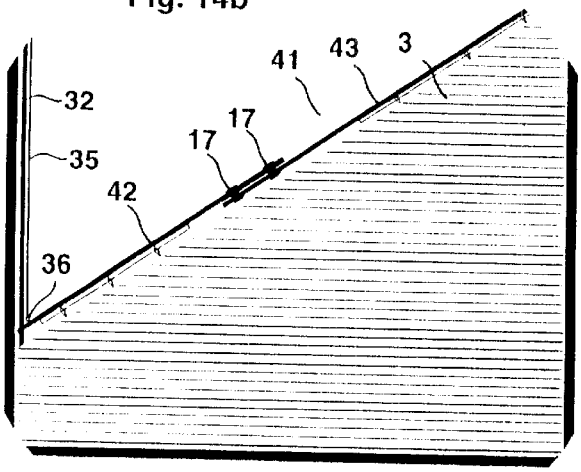
FIG. 14*b* is a partial view of a pitched window shade using the horizontal sliding headrail embodiment.
Figure 14E:
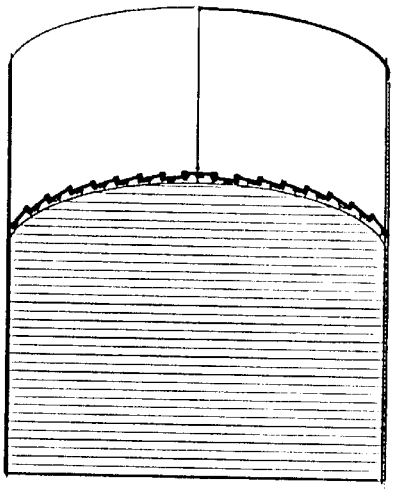
FIG. 14*e* is a view of an arched window with a horizontal sliding headrail embodiment and the shade partially closed.
Figure 14C:
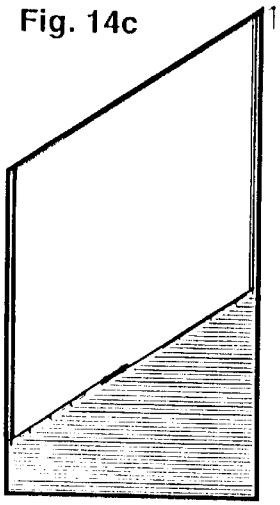
FIG. 14*c* is a view of a pitched window with a horizontal sliding headrail embodiment and the shade partially closed.
Figure 14D:
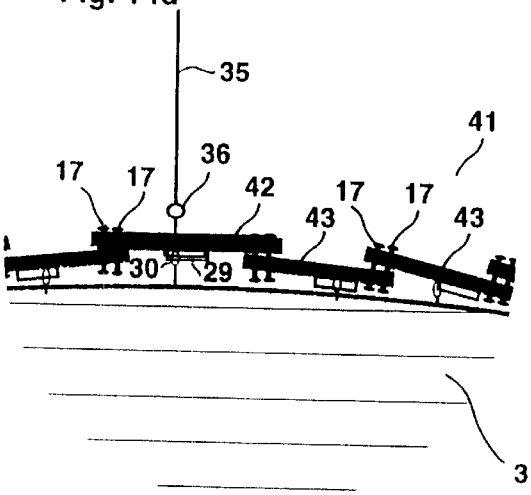
FIG. 14*d* is a partial view of an arched embodiment of the horizontal sliding headrail.

Another embodiment incorporating a horizontal construction of the present invention is disclosed in FIGS. 14*a*, 14*b*, and 14*c*. In this embodiment, instead of overlapping in a vertical plane, the upper headrail sections 42 and lower headrail sections 43 overlap in horizontal layers. Rather than utilizing two separate slots per connection between upper headrail sections 42 and lower headrail sections 43, the horizontal sliding headrail 41 functions with one travel slot 14. Two slot pins 17 are used within each travel slot 14, each controlling the length of expansion and contraction of the horizontal sliding headrail 41, and the combination preventing rotation along the horizontal plane of the horizontal sliding headrail 41. In a pitched lintel application, the length of the slot pins 17 are chosen to allow minimal displacement between the upper headrail section 42 and the lower headrail section 43. In an arched lintel application the length of the slot pins 17 are sized to create greater displacement between the upper headrail sections 42 and lower headrail sections 43 which allows the headrail sections 42 and 43 to tilt against or cascade off one another, thereby creating the arched form when drawn upwards off the sill 6. As this configuration is not as aesthetically pleasing as a vertical sliding headrail 8 embodiment, it is less preferred although functional.

Figure 16:
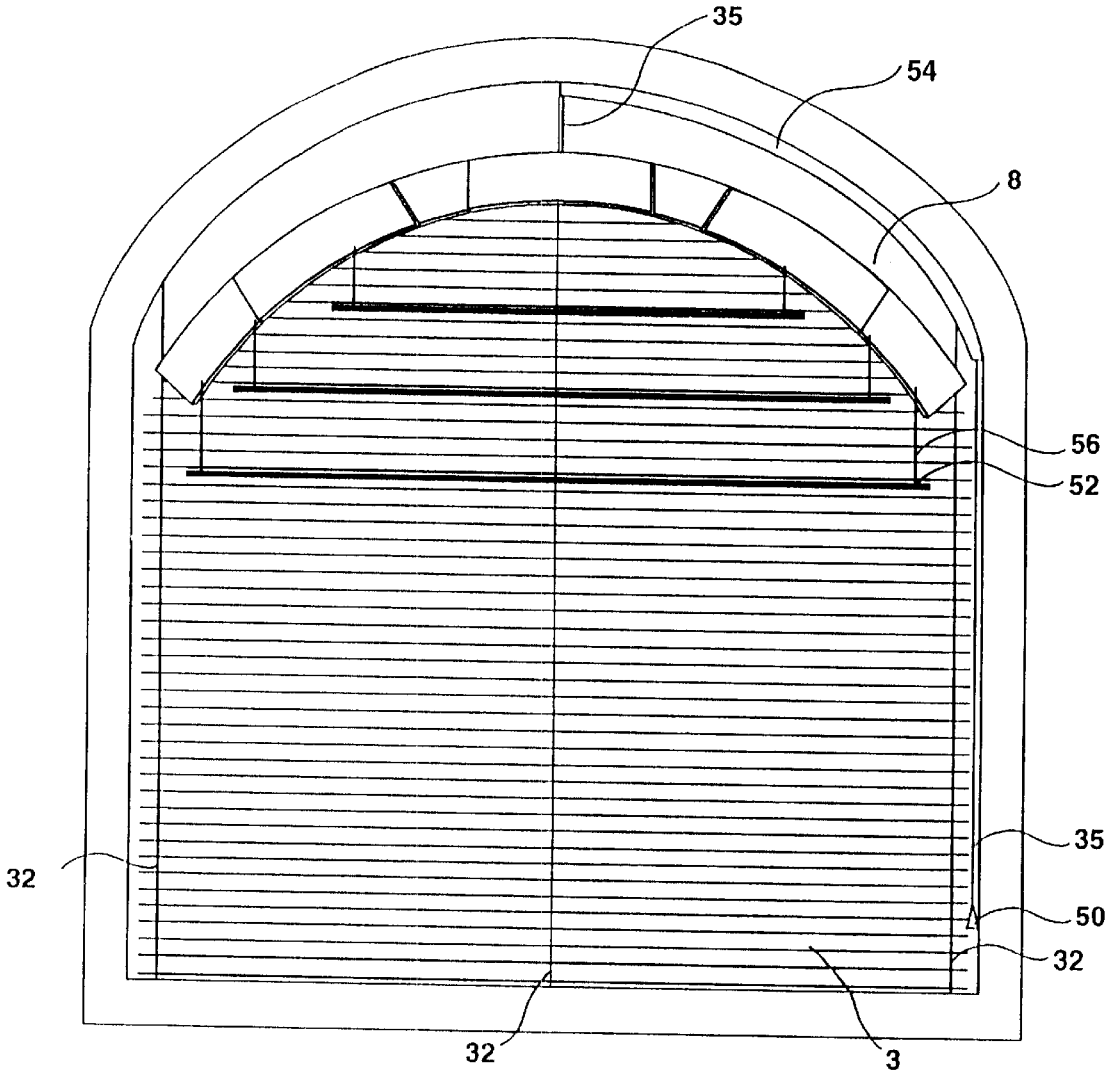
FIG. 16 is a rear cut-away view of a rear mounted sliding headrail in an arched application incorporating support rods within the shade material.
Figure 23:
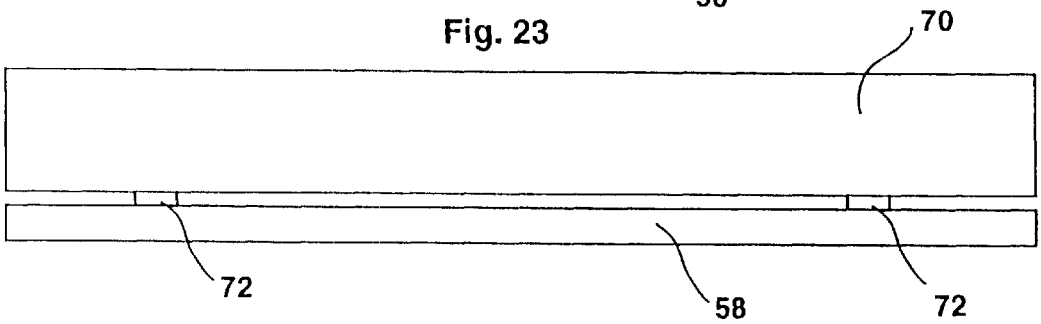
FIG. 23 is a top view of a single headrail segment with an attached valance.

A further embodiment incorporating additional support for the shade material is shown in FIGS. 16, 17, 18, 19 and 23. In FIGS. 16 and 23, support rods 52 are inserted along the interior of honeycomb-type shade material 3. A slit 53 or other opening is cut into shade material 3 to allow for attachment of support rod cords 56 at various points along a support rod 52. Support rod cords 56, similar to draw cords 35 and guide wires 32, may be made of metal wire, cord, monofilament or any similar flexible, tensilely strong material. The opposite end of each support rod cord 56 is attached to a point on the headrail section 9 or 10 directly above the attachment point on the support rod. Attachment means for the support rod cord 56 to either the support rod 52 or a headrail section 9 or 10 may consist of tying, adhesing, pinning, bolting, screwing, nailing, or any other well known means of suitably fastening the support rod cord 56 material. Support rods 52 may be used with other shade materials 3 by fastening the support rods 52 to the shade material 3 through other means such as adhesive, fabric loops, stitching, or other similarly suitable means.

Figure 17:
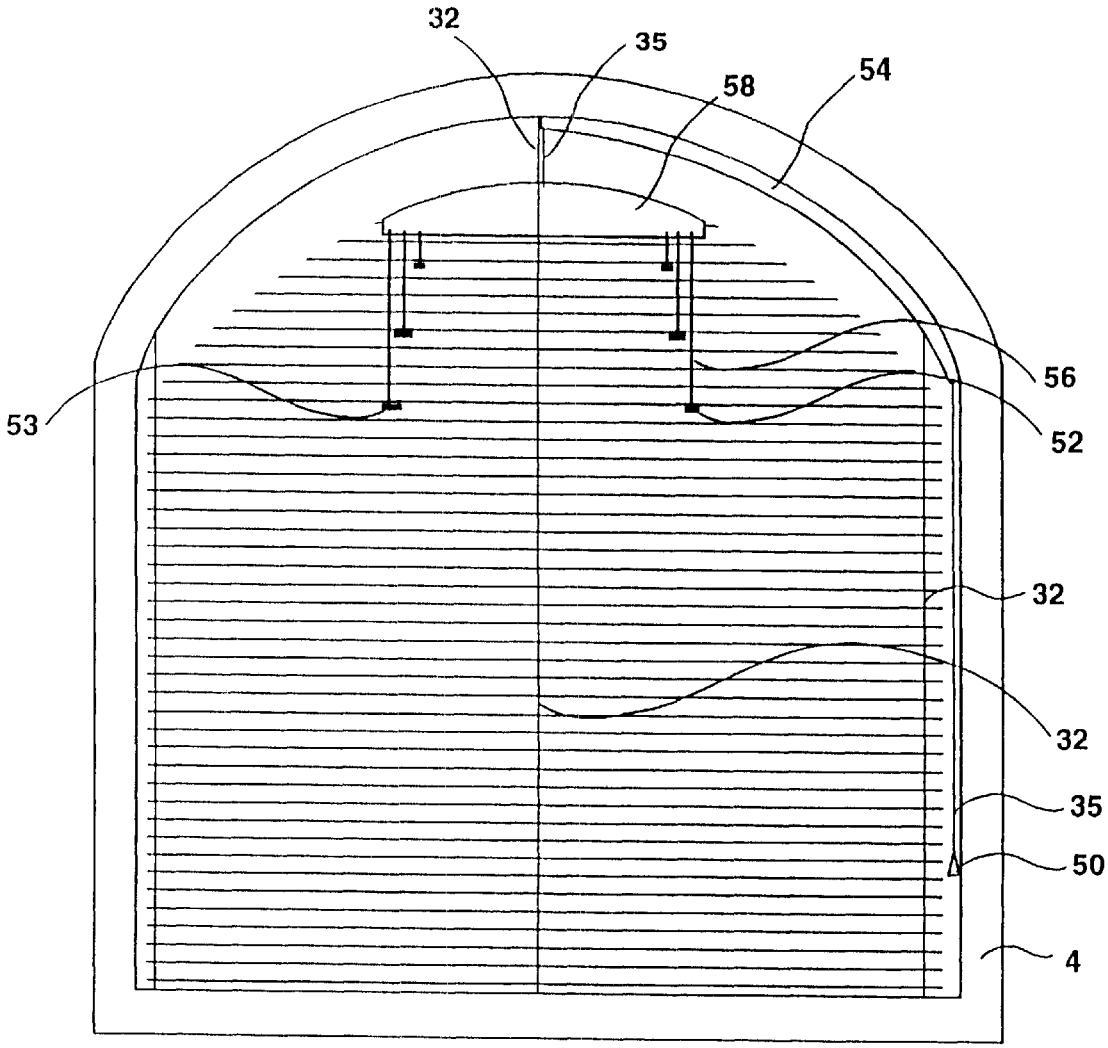
FIG. 17 is a rear view of a rear mounted single headrail in an arched application incorporating support rods.
Figure 18:
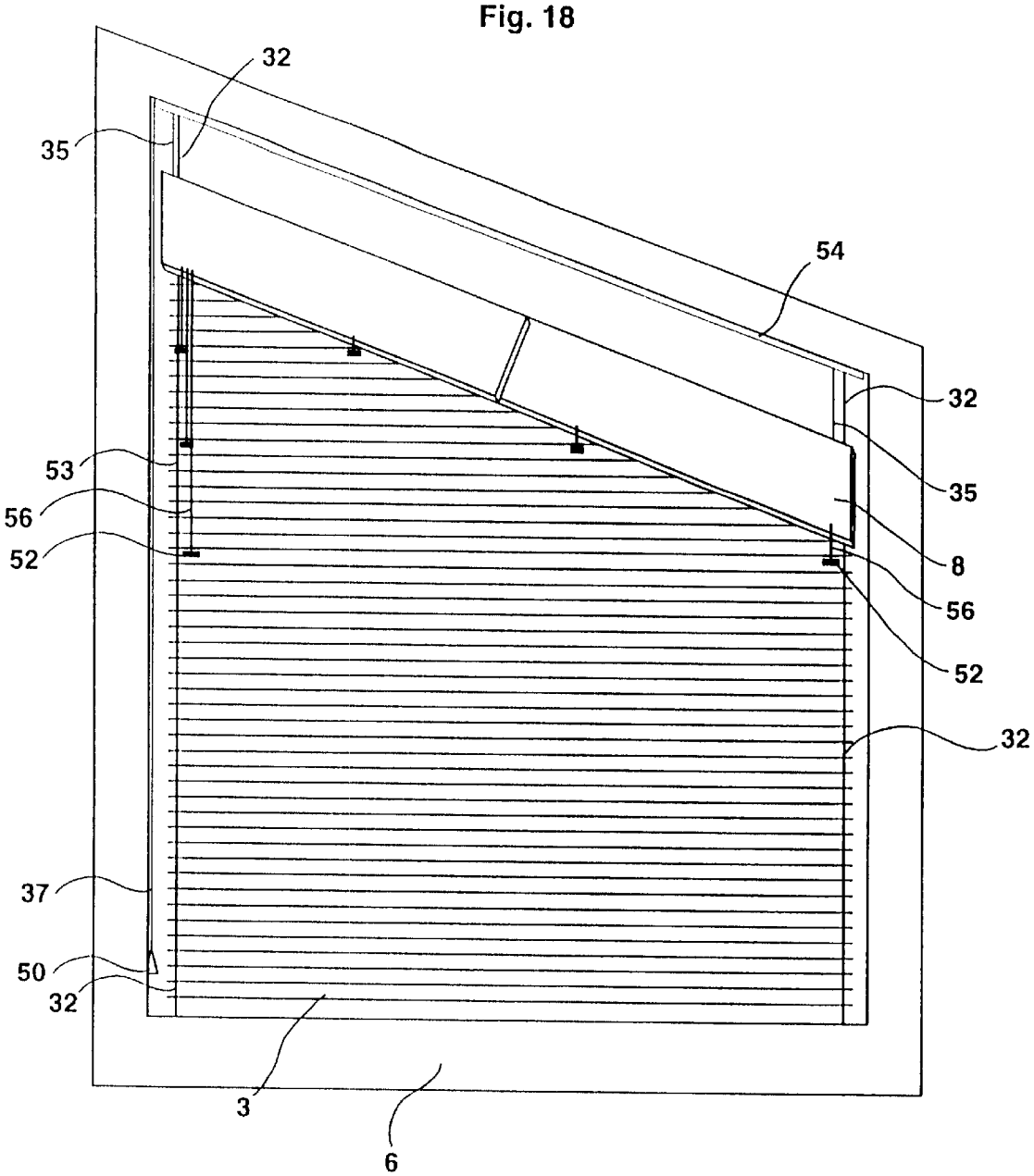
FIG. 18 is a rear view of a rear mounted sliding headrail in a pitched application incorporating support rods.
Figure 19:
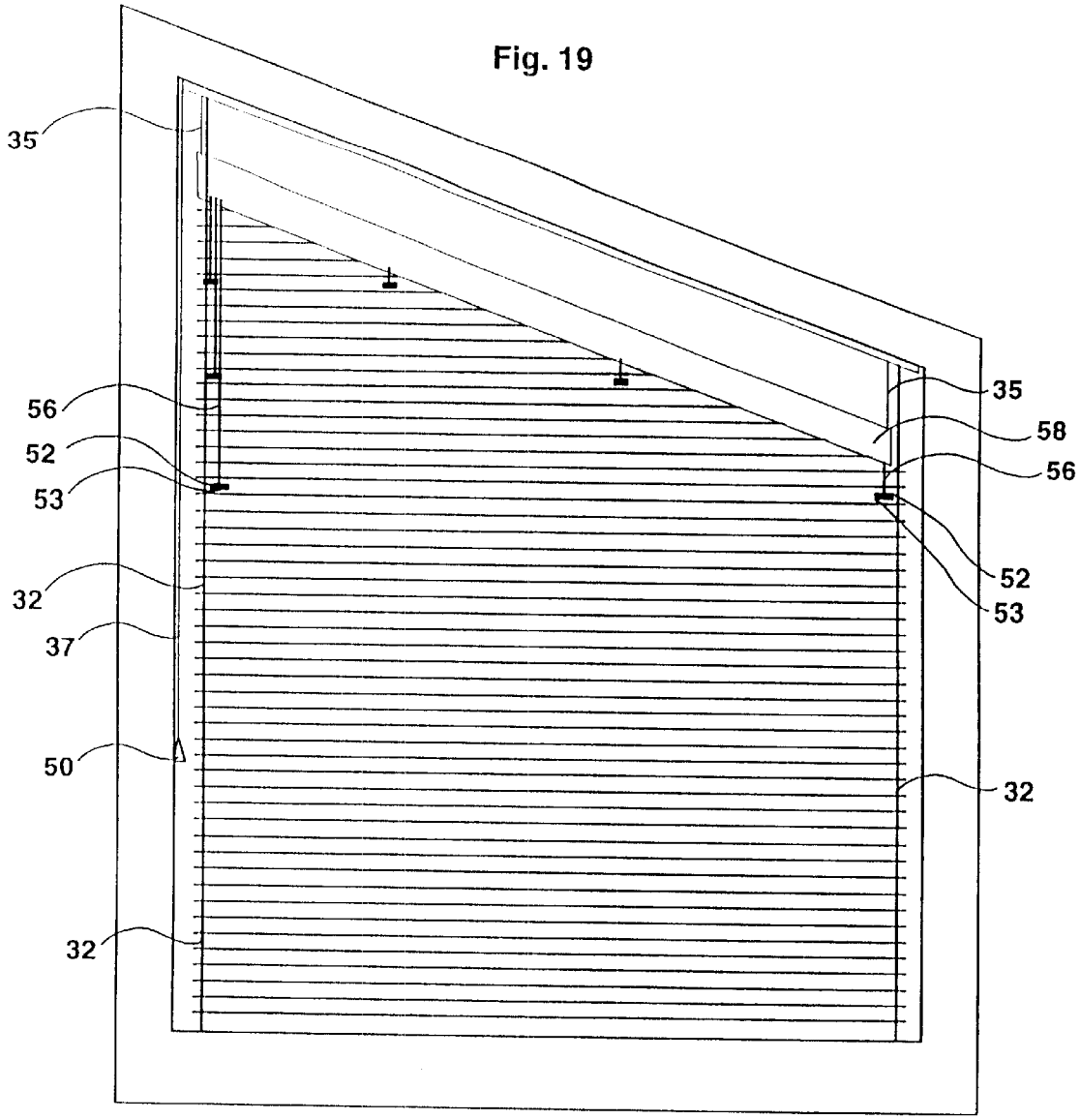
FIG. 19 is a rearview of a rear mounted single headrail in a pitched application incorporating support rods.

The support rods 52 may be composed of most any suitable lightweight, rigid material such as wood, plastic, metal, resin, composite, or other similar material. The support rods 52 may run the width of the shade material 3, or they may be of any shorter length suitable for providing support to the shade material 3. When the sliding headrail 8 is raised, the support rod cords 56 become taught and lift the support rods 52, thereby lifting the shade material 3. By utilizing support rods 52 at various heights on the shade material 3, the stress on any one portion of the shade material 3, for example at the eyelet attachment holes 31 along the top edge, is reduced and distributed throughout the shade material 3. The support rods 52, additionally help the shade material 3 lay flat on the sill 6 when the window shade 2 is open due to the additional weight of the support rods 52 laying on the shade material 3. FIGS. 17, 18, and 19 show the support rods used in single headrail and pitched lintel applications.

Figure 26A:
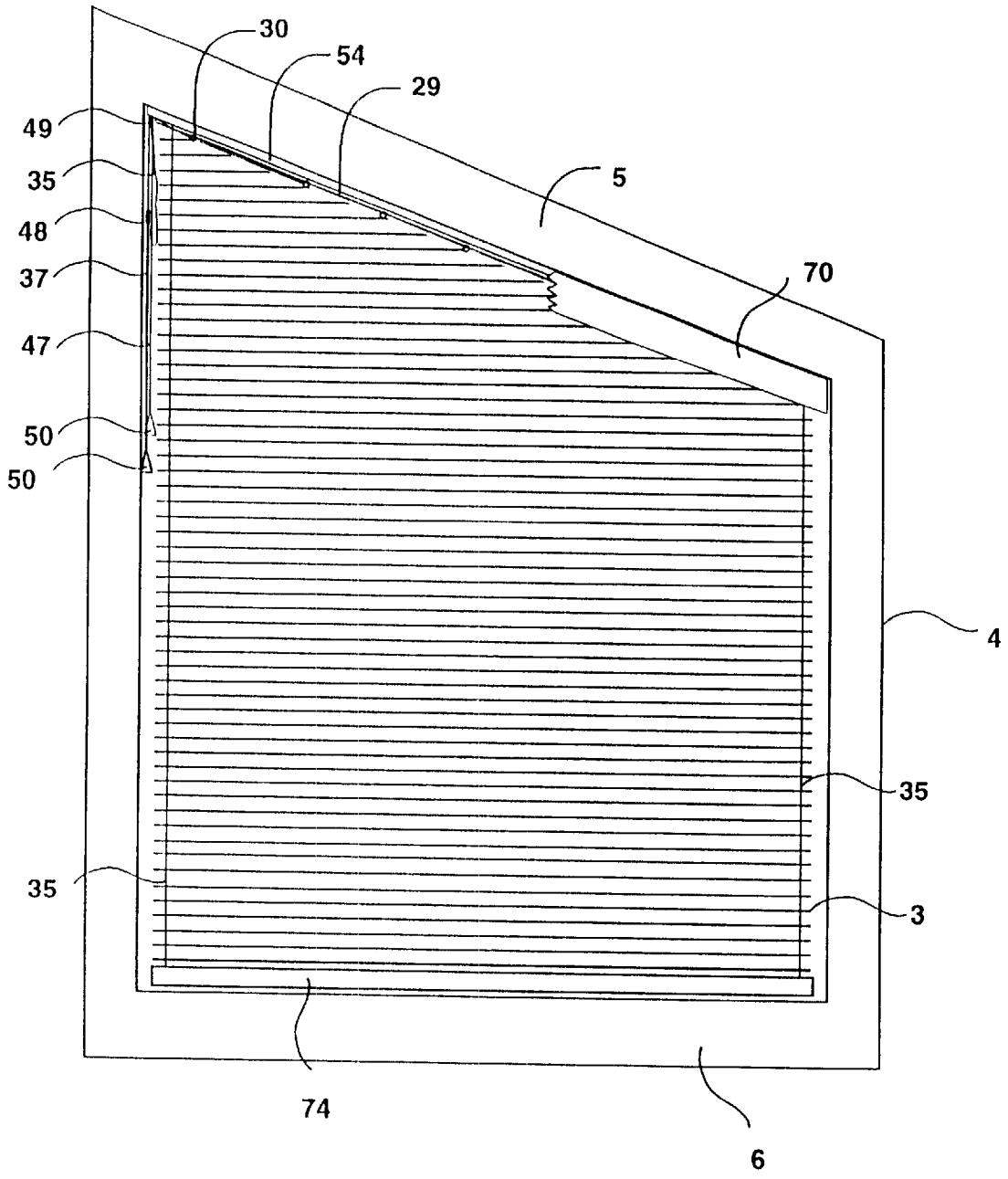
FIG. 26*a* is a front view of an embodiment combining a shade leveling rod with a weighted support rod in a pitch lintel application with the shade closed.
Figure 26B:
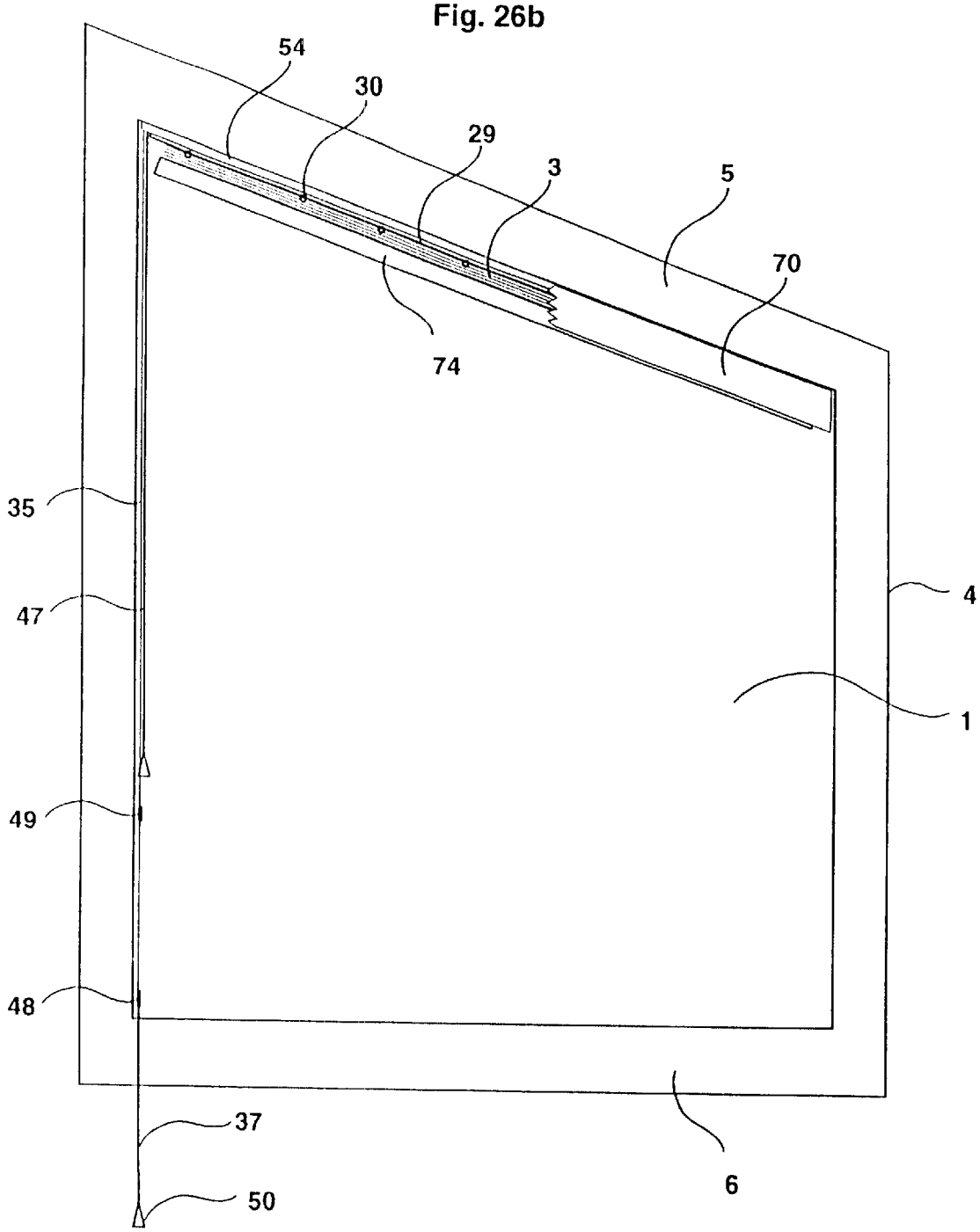
FIG. 26*b* is a front view of an embodiment combining a shade leveling rod with a weighted support rod in a pitch lintel application with the shade open.

Another embodiment in a lintel 5 mounted application as seen in FIGS. 26*a* and 26*b* incorporates the shade leveling rod 29 and uses a bottom rail 74 disposed along the bottom edge of the shade material 3. The top edge of the shade material 3 is attached via eyelets 30 to one or more shade leveling rods 29 mounted to the lintel 5. This provides for free lateral movement of the shade material 3 along the lintel 5 as the window shade 2 is drawn open toward the lintel 5.

The bottom rail 74 may be similar to the support rods 52 of FIGS. 17–19 and 24 including composition and attachment means. The bottom rail 74 is generally heavier than support rods 52 in order to ensure the bottom edge of the shade material 3 lays upon the sill when the window shade 2 is fully closed. Distinct from the support rod 52 embodiment, draw cords 35 are attached to the bottom rail 74 to raise or lower the bottom edge of the shade material 3. Draw cords 35 are joined to pull cord 37 via cord connector 48 for ease of use by a user.

In a pitched lintel application, as in FIGS. 26*a* and 26*b*, there may be merely a single bottom rail 74 running the length of the bottom edge of the shade material 5. In lieu of any special manufacture, a standard bottom rail as found on most window shades 2 may also suffice. Draw cords 35 may be connected to the bottom rail 74 toward the lateral edges of the shade material 3. As the window shade 2 is opened and the bottom of the shade material 3 approaches the lintel 5, a first lateral edge of the bottom edge of the shade material 3 will reach the lintel 5 before the opposite lateral edge. When the first lateral edge of the bottom edge reaches the lintel 5, further movement of the respective draw cord 35 is arrested. Then as the opposite edge continues to travel toward the lintel 5 at the highest point of the pitch, the upper edge of the shade material 3 is free to travel along the shade leveling rod 29. In this manner, the shade material 3 is not stretched or stressed as the shade material 3 is pulled toward the highest point of the pitch due to the greater length of the lintel 5 as compare to the width of the window frame 4.

Figure 27A:
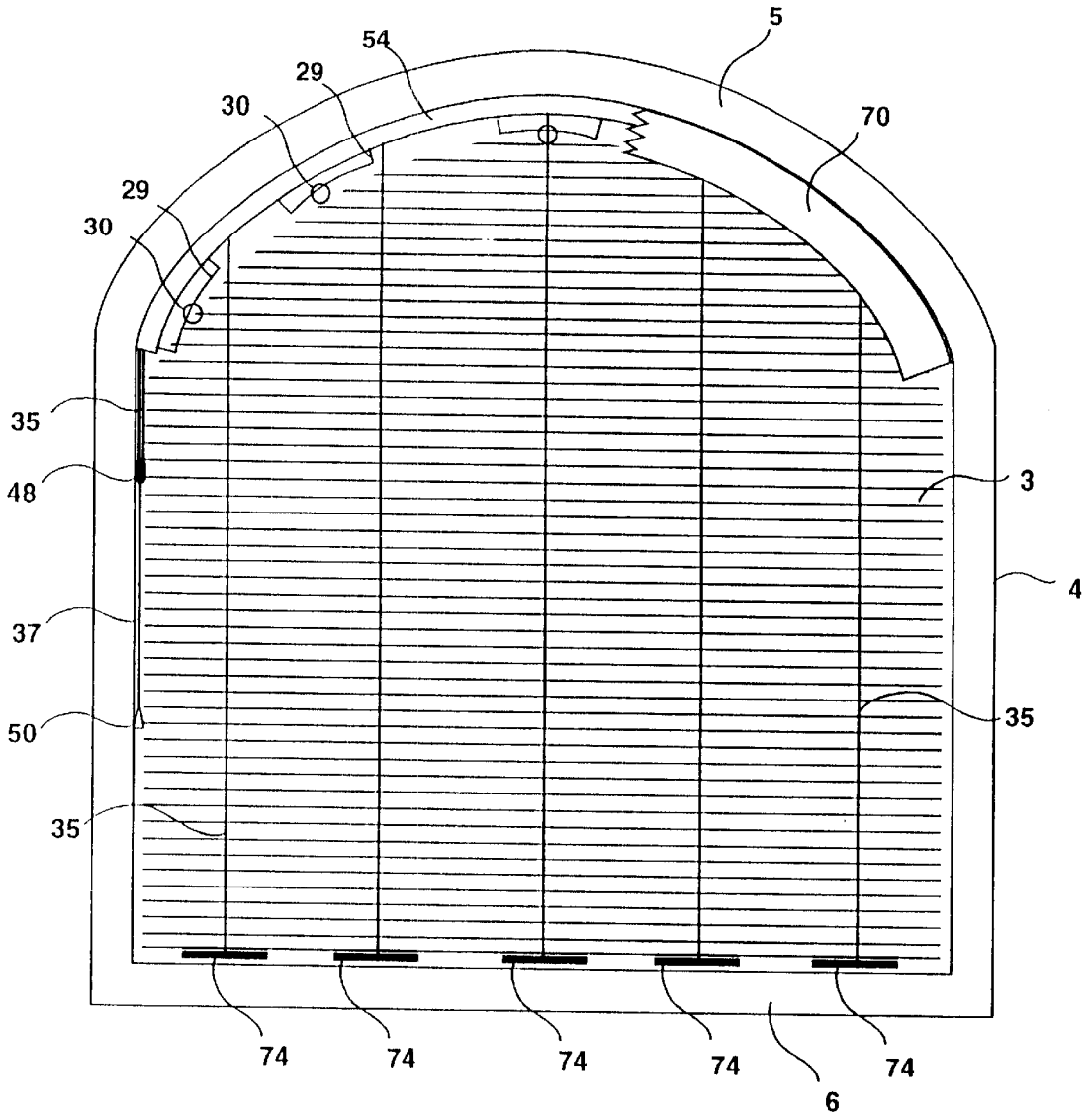
FIG. 27*a* is a front view of an embodiment combining a shade leveling rod with weighted support rods in an arched lintel application with the shade closed.
Figure 27B:
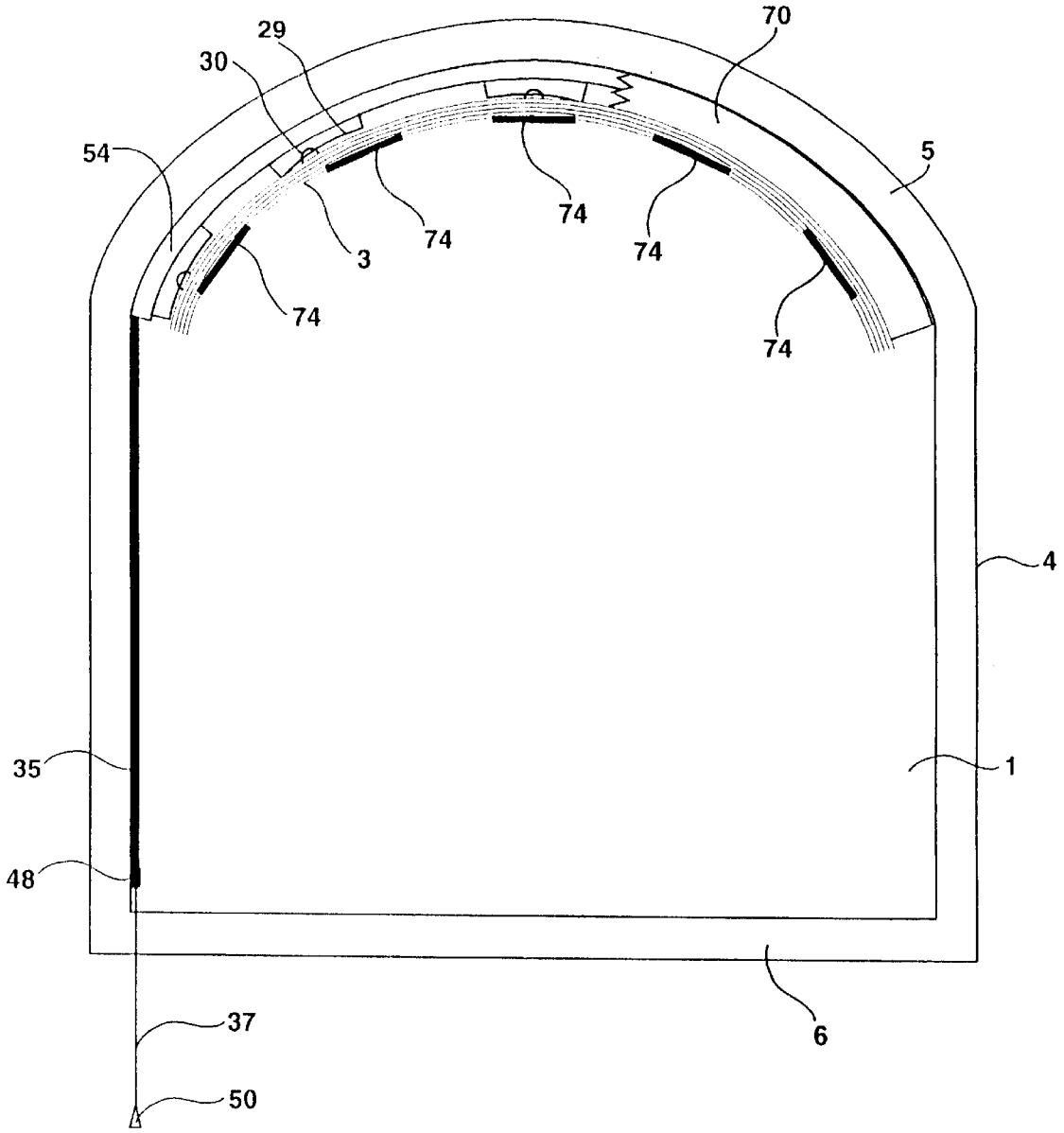
FIG. 27*b* is a front view of an embodiment combining shade leveling rods with weighted support rods in an arched lintel application with the shade open.

In an arched lintel application shown in FIGS. 27*a* and 27*b*, the upper edge of the shade material 3 attached to the shade leveling rods 29 travels freely while the shade material 3 is pulled against and in conformance with the lintel 5. In an arched application, a sectional bottom rail 74 may be used along the bottom edge of the shade material 3. This allows the shade material 3 to be pulled with multiple draw cords 35, as in sections, snugly against the contour of the lintel 5. If the bottom rail 74 is made of a sufficiently flexible material, a single bottom rail 74 with multiple draw cords 35 and attachment points may also suffice.

Figure 22A:
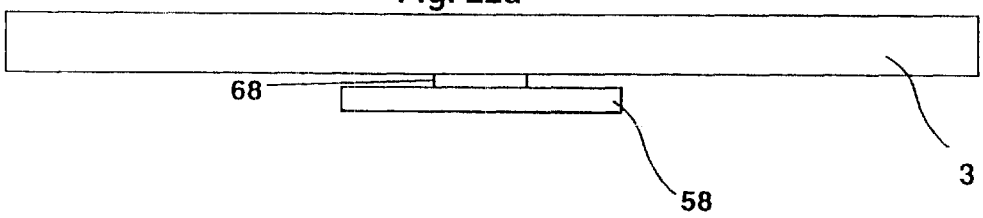
FIG. 22*a* is a top view of a single headrail segment utilizing a shade elevating rod to support shade material.
Figure 22B:
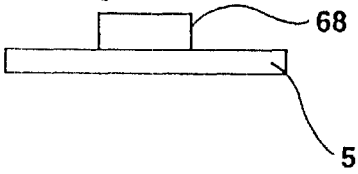
FIG. 22*b* is a top view of a single headrail segment with a shade elevating rod.
Figure 24:
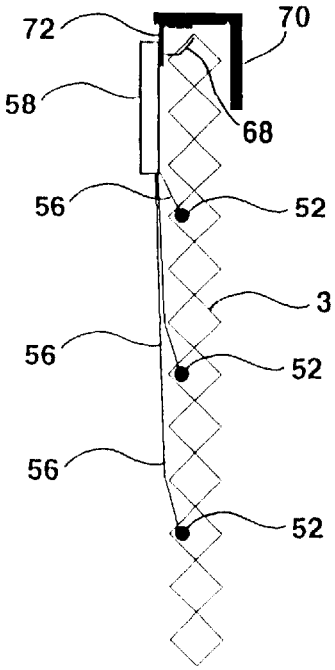
FIG. 24 is a side view of a headrail segment utilizing a shade elevating rod and support rods and which is covered by a valance.

FIGS. 22*a*, 22*b*, and 24 depict a single headrail 58 used in conjunction with a shade elevating rod 68 for supporting shade material. A single headrail 58 may be all that is necessary for use in narrow windows or the angle of pitch or curvature is small. Rather than attaching the single headrail 58 to the shade material 3 with eyelets, the shade elevating rod 68 may be inserted through the top cell of honeycomb shade material 3 or placed within a seam or otherwise attached along the top edge of other shade material 3. The shade elevating rod 68 provides distributed support along a length of the top edge of the shade material 3. The shade elevating rod 68 may additionally be formed in an arc to provide a snug fit against the lintel 5. Similar to a shade leveling rod 29, the shade elevating rod 68 may be composed of wire, metallic rods, or other similar thin-gauge, rigid, tensilely strong material which will not sag.

A decorative valance 70 shown in FIGS. 23 and 24 may be attached to a single headrail 58 via valance brackets 72. The valance 70 and valance brackets 72 may be composed of any suitably dense, rigid material such as wood, plastic, metal, resin, composite, or other similar material. The valance brackets 72 may be attached to the single headrail 58 and the valance 70 via any suitable fastening means such as nails, screws, bolts, rivets, adhesive, or other similar means. The valance 70 may operate to obscure any exposed hardware attachments to the single headrail 58 and additionally provide a tidy cover for the shade material 3 when it rests upon the sill 6.

Figure 25:
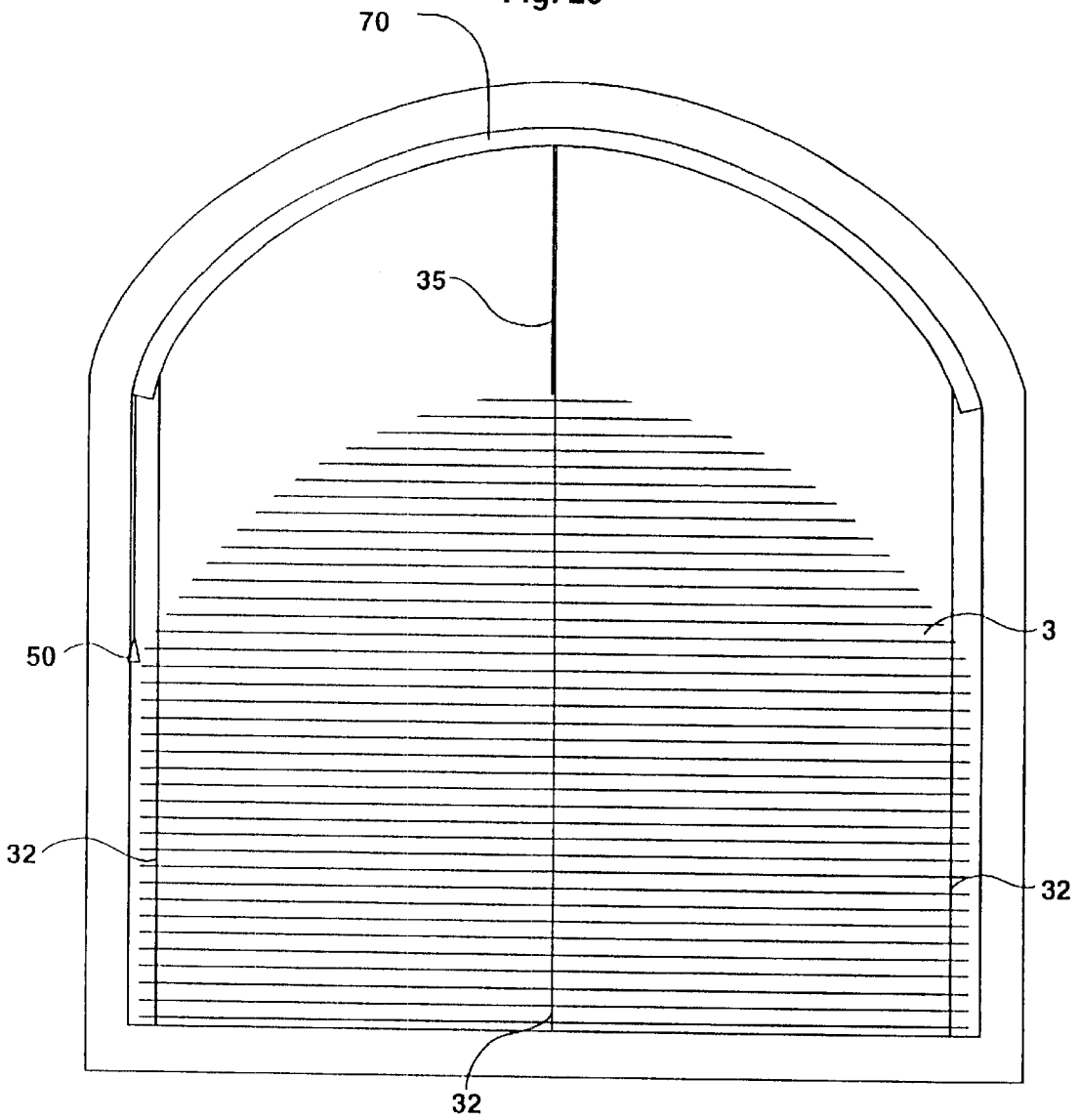
FIG. 25 is a front view of a valance in use in an arched lintel application.

In an arched lintel application, a valance 70 may also be employed as shown in FIG. 25. Here, rather than attaching the valance 70 a sliding headrail 8 or a single headrail 58, the valance 70 is mounted directly to the lintel 5. The valance 70 is a facade used to cover light gaps created by uneven cutting of the shade material 3 or an imperfect window frame 4. The valance 70 may be constructed out of any suitably flexible, resilient material such a plastic, metal, resin, composite, wood or other similar material. The valance 70 may be attached to the lintel 5 by any suitable fastening means such as nails, screws, bolts, rivets, adhesive, or other similar means.

A final aspect to this inventive system is a cord track 54, as shown in FIGS. 16–21*b*, which provides for smooth operation of the draw cord 35. The cord track 54 acts as a guide for the draw cord 35 along the lintel 5, preventing the draw cord 35 from sagging and becoming entangled in the sliding headrail 8 assembly. The cord track 54 also hides the draw cord 35, providing a more aesthetically pleasing lintel 5. The cord track 54 may be mounted on the surface of the lintel 5 or it may be recessed along the length of the lintel 5. The cord track 54 may be composed of any suitably dense material such as wood, metal, plastic, resin, composite, or other similar material. In an arched application the material composing the cord track 54 should also be sufficiently flexible to conform to the curvature of the lintel 5. Preferably, the cord track 54 material should have a low coefficient of friction to prevent unnecessary wear on the draw cord 35 as it moves along and within the cord track 54.

Figure 20A:
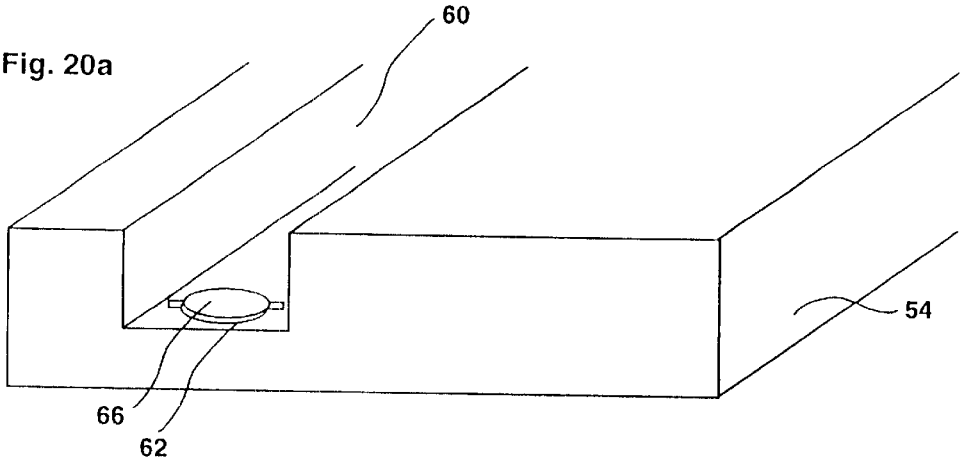
FIG. 20*a* is a partial end perspective view of a cord track with a cord guide.
Figure 20B:
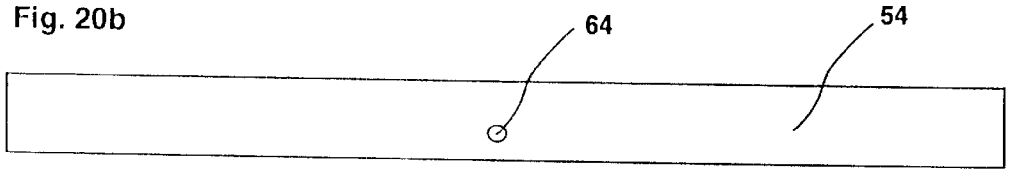
FIG. 20*b* is an exterior view of a cord track for an arched lintel application.
Figure 20C:
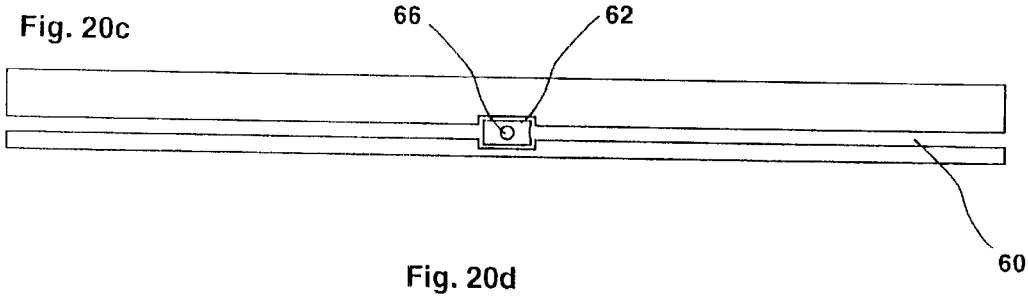
FIG. 20*c* is an interior view of a cord track for an arched lintel application.
Figure 20D:
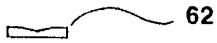
FIG. 20*d* is an end perspective view of a cord guide used in conjunction with a cord track.

The cord track 54 may consist of several components including a cord path 60 and cord guides 62, FIGS. 20*a*, 20*c* and 20*d*. In an arched lintel 5 application, there is only one draw cord 35 which pulls the sliding headrail 8 from the center of the lintel 5. An aperture in the center of the cord track 54, identified as the cord track hole 64 allows the draw cord to pass into the cord path 60. In a case where the cord track 54 material is not sufficiently friction resistant, a cord guide 62 may be mounted within the cord path 60. The draw cord 35 travels through the cord guide hole 66 and over the cord guide 62 before proceeding along the cord path 60. The cord guide 62 is composed of a material with a very low coefficient of friction which may be beveled around the cord guide hole, or it may be a structure incorporating bearings, to reduce the stress of friction on the draw cord 35 at the fulcrum point. Several possible embodiments of a cord guide are depicted in FIGS. 20*a*, 20*c*, 20*d*, 21*b*, and 21*d*.

Figure 21A:
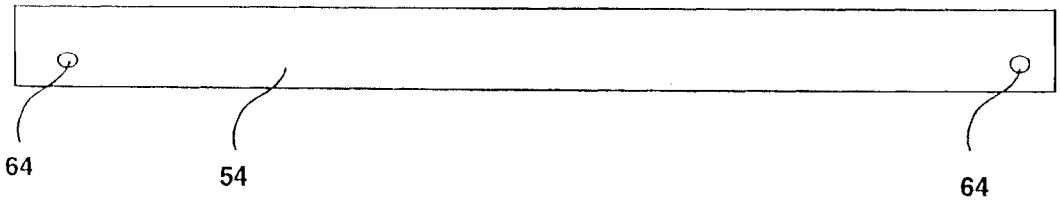
FIG. 21*a* is an exterior view of a cord track for a pitched lintel application.
Figure 21B:
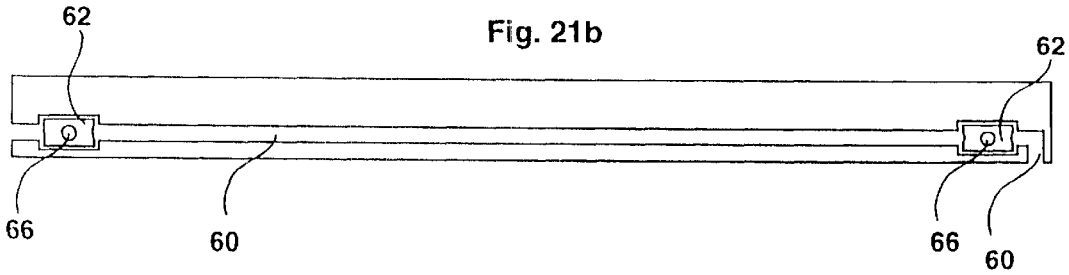
FIG. 21*b* is an interior view of a cord track for a pitched lintel application.
Figure 21C:
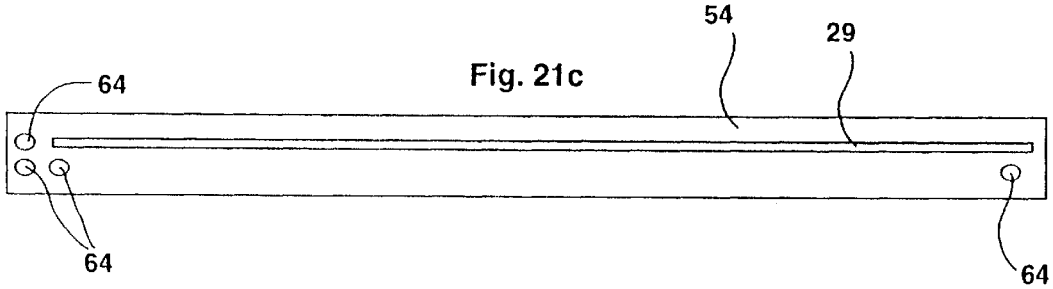
FIG. 21*c* is an exterior view of an alternative embodiment of a cord track for a pitched lintel application.
Figure 21D:
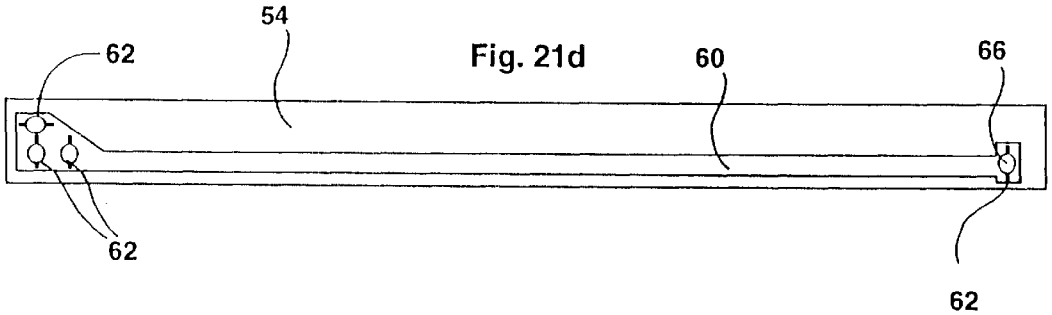
FIG. 21*d* is an interior view of an alternative embodiment of a cord track for a pitched lintel application.

In an arched application, the cord path 60 may extend from either side of the cord track hole 64 to allow the user to select the side of placement for user access to the draw cord 35. FIGS. 21*a* and 21*b* depict a cord track 54 arrangement for a pitched lintel 5 application. In this embodiment, the cord track 54 includes cord track holes 64 and cord guides 62 on both ends. On the chosen side of user access, the draw cords 35 exit the cord path 60 in the cord track 54 to connect with pull cord 37. The draw cords may exit through a single cord track hole 64 with a cord guide 62, as in FIGS. 21*a* and 21*b*, or through multiple cord track holes 64 with respective cord guides 62, as in FIGS. 21*c* and 21*d*. Multiple outlets for draw cords 35 may be desirable, for example, when a cord stop 29 is used on one draw cord 35; a second cord track hole 64 for the second draw cord 35 allows continued movement of the second draw cord 35 without interference by the cord stop 49 on the first draw cord 35.

We claim:

1. A window shade apparatus for covering a window having a sill, the apparatus comprising:

(a) a headrail composed of at least two elongated sections, said elongated sections overlap in an alternating posterior and anterior arrangement;

(b) a means for attaching the headrail sections, the attachment means allowing for horizontal and vertical movement between and relative to the headrail sections within a plane parallel to the plane of the window;

(c) shade material, a portion of the perimeter of which is defined as a top edge and a portion of the perimeter of which is defined as a bottom edge; and (d) means for moveably attaching the top edge of the shade material to the headrail, the attachment means allowing for movement of the top edge of the shade material parallel to the respective headrail section to which a particular portion of the shade material is attached.

2. The window shade apparatus of claim 1 wherein the means for attaching the headrail sections comprises:

(a) a first pin fixedly attached to an anterior headrail section and passing through a first linear aperture in a posterior headrail section, the first linear aperture parallel to the horizontal, relative to the length of the posterior headrail section;

(b) a second pin fixedly attached to the anterior headrail section and passing through a second linear aperture in the posterior headrail section, the second linear aperture at an acute angle to the horizontal, relative to the length of the posterior headrail section; and (c) both the first and second pins movably secured to the posterior headrail section to allow movement of the first and second pins within and along the first and second linear apertures, respectively.

3. The window shade apparatus of claim 2 wherein the acute angle is of zero degrees, resulting in the second linear aperture being parallel to the length of the posterior headrail section, thereby arresting any vertical movement between the posterior and anterior headrail sections.

4. The window shade apparatus of claim 2 wherein the second linear aperture is arcuate, approximating the addition of a symmetrical linear aperture at an acute angle on the opposite side of the horizontal to the second linear aperture as described in claim 2.

5. The window shade apparatus of claim 2 wherein the linear apertures further comprise adjustable apertures, each adjustable aperture comprising:

(a) a turntable with a rotating plate and a base, the base recessively mounted in the posterior headrail section, the rotating plate capable of full circular rotation relative to the base;

(b) the rotating plate containing a linear aperture of length less than the diameter of the rotating plate;

(c) the posterior headrail section containing a hole with a diameter length the same as the length of the linear aperture in the rotating plate, the hole concentric with the rotating plate;

(d) an aperture length adjustment means for lengthening and shortening the length of the linear aperture;

(e) a plate engagement means for arresting the rotation of the plate and locking the plate in a fixed position relative to the base.

6. The window shade apparatus of claim 1 further comprising a second means for attaching the headrail sections, the second attachment means allowing for limited rotational movement between and relative to the headrail sections within a plane parallel to the plane of the window.

7. The window shade apparatus of claim 1 further comprising a second means for attaching the headrail sections, the second attachment means allowing for limited rotational movement between and relative to the headrails sections within a plane parallel to the plane of the window.

8. The window shade apparatus of claim 7 wherein the second means for attaching the headrail sections further comprises:

(a) a hinge section anterior to at least one posterior headrail section to allow rotation between the hinge section and the posterior headrail section;

(b) a hinge connecting the hinge section to the posterior headrail section at respective axis points; and (c) a hinge stop to limit the rotation between the hinge section and the posterior headrail section.

9. The window shade apparatus of claim 8 wherein (a) the hinge comprises a pin passing through a hole contained in the posterior headrail section, at the axis point of the posterior headrail section, the pin movably attached to the posterior headrail section and fixedly attached to the axis point on the hinge section; and (b) the hinge stop comprises a pin fixedly attached to and protruding from the hinge section to impede the rotational movement of the posterior headrail section relative to the hinge section.

10. The window shade apparatus of claim 1 wherein the means for attaching the top edge of the shade material further comprises:

(a) one or more guides attached to and displaced from the headrail, each guide parallel to the length of the headrail section to which it is attached;

(b) the shade material containing one or more holes adjacent to the top edge of the shade material;

(c) one or more eyelets, respective in number to the number of holes in the shade material, the eyelets passing through the holes, respectively; and (d) the eyelets additionally passing around the guides, thereby allowing the top edge of the shade material to travel along the guides with minimal friction thus alleviating stress or drag on the shade material.

11. The window shade apparatus of claim 1 further comprising one or more intermediate support members fixedly attached to the shade material at one or more locations, respectively, the locations intermediate to the top edge and bottom edge of the shade material, each intermediate support member connected to the headrail by a cord of length such that the cord is pulled taught by the weight of the shade material when the headrail is raised such that the respective location of the intermediate support member is lifted from the sill.

12. The window shade apparatus of claim 1 wherein the elongated sections overlap in an alternating superior and inferior arrangement.

13. The window shade apparatus of claim 12 wherein the means for attaching the headrail sections comprises:

(a) a first pin fixedly attached to a superior headrail section and passing through a linear aperture in an inferior headrail section, the linear aperture parallel to the horizontal, relative to the length of the posterior headrail section;

(b) a second pin, spaced apart from the first pin, fixedly attached to the superior headrail section, and passing through the linear aperture in the inferior headrail section; and (c) both the first and second pins movably secured to the inferior headrail section to allow movement of the first and second pins along and within the linear aperture, the pins of such length to allow or prevent vertical movement between the headrail sections as desired.

14. The window shade apparatus of claim 12 wherein the means for attaching the top edge of the shade material further comprises:

(a) one or more guides attached to and displaced from the headrail, each guide parallel to the length of the headrail section to which it is attached;

(b) the shade material containing one or more holes adjacent to the top edge of the shade material;

(c) one or more eyelets, respective in number to the number of holes in the shade material, the eyelets passing through the holes, respectively; and (d) the eyelets additionally passing around the guides, thereby allowing the top edge of the shade material to travel along the guides with minimal friction thus alleviating stress or drag on the shade material.

15. A means for moveably attaching shade material to a movable headrail, such means for attaching comprising:

(a) one or more guides attached to and displaced from the headrail, each guide is along the length of the headrail section to which it is attached;

(b) the shade material containing one or more holes adjacent to an edge of the shade material;

(c) one or more eyelets, respective in number to the number of holes in the shade material, the eyelets passing through the holes, respectively; and (d) the eyelets additionally passing around the guides, thereby allowing the edge of the shade material to travel along the guides with minimal friction thus alleviating stress or drag on the shade material.

16. A window shade apparatus for covering a window having a lintel and a sill, the apparatus comprising:

(a) shade material, a portion of the perimeter of which is defined as a top edge and a portion of the perimeter of which is defined as a bottom edge;

(b) a headrail, the headrail is positioned slightly below the top edge of the shade material and between the shade material and the window;

(c) a shade elevating rod comprising a first part fixedly attached to the headrail and a second part fixedly attached to the top edge of the shade material, the second part of the shade elevating rod extending distally from the headrail;

(d) means for raising and lowering the headrail and thereby the shade material to cover and uncover the window, respectively, such means attached to the headrail; and (e) means for attaching the bottom edge of the shade material to the sill.

17. The window shade apparatus of claim 16 wherein the top edge of the headrail is formed to conform to the shape of the lintel.

18. The window shade apparatus of claim 16 wherein the second part of the shade elevation rod is formed to conform to the shape of the lintel.

19. The window shade apparatus of claim 16 wherein the shade elevation rod comprises a malleable rod with two ends and a midsection, the first part of the shade elevation rod defined by the ends of the rod, and the second part of the support member defined by the midsection.

20. The window shade apparatus of claim 19 wherein the midsection of the rod is formed to conform to the shape of the lintel.

21. The window shade apparatus of claim 16 wherein the means for raising and lowering comprises one or more cords attached to a headrail, each cord:

(a) movably supported at a respective fulcrum point each fulcrum point centered over respective attachment points of the cords to the headrail;

(b) routed through a channel for easy access by a user; and (c) engagingly attached to engagement means.

22. The window shade apparatus of claim 21 further comprising a channel formed to fit the shape of and fixedly mounted to the lintel, the channel enclosing and directing the cords along the lintel to the side of the window.

23. The window shade apparatus of claim 22 wherein the channel is recessed within the lintel.

24. The window shade apparatus of claim 22 wherein the fulcrum points are comprised of apertures within the channel.

25. The window shade apparatus of claim 16 further comprising:

(a) one or more intermediate support members attached to the shade material at one or more locations;

(b) the locations intermediate to the top edge and bottom edge of the shade material; and (c) each intermediate support member connected to the headrail by a cord of length such that the cord length is pulled taught when the shade material is hanging when the headrail is raised.

26. A window shade apparatus for covering a window, the apparatus comprising;

a) a headrail composed of at least two elongated sections;

b) a means for attaching the headrail sections, the attachment means allowing for horizontal and vertical movement between the headrail section within a plane parallel to the plane of the window;

c) shade material, a portion of the perimeter of which is defined as a top edge and a portion of the perimeter which is defined as a bottom edge;

d) means for movably attaching the top edge of the shade material to the headrail, the attachment means allowing for movement of the top edge of the shade material parallel to the respective headrail section to which a particular portion of the shade material is attached; and e) a second means for attaching the headrail sections, the second attachment means allowing for limited rotational movement between and relative to the headrail sections within a plane parallel to the plane of the window.

27. A window shade apparatus for covering a window, the apparatus comprising:

a) a headrail composed of at least two elongated sections, said elongated sections overlap in an alternating superior and inferior arrangement;

b) means for attaching the headrail sections, the attachment means allowing for horizontal and vertical movement between and relative to the headrail sections within a plane parallel to the plane of the window;

c) shade material, a portion of the perimeter of which is defined as a top edge and a portion of the perimeter of which is defined as a bottom edge;

d) means for moveably attaching the top edge of the shade material to the headrail, the attachment means allowing for movement of the top edge of the shade material parallel to the respective headrail section to which a particular portion of the shade material is attached; and e) the means for attaching the headrail sections further includes:

(1) a first pin fixedly attached to a superior headrail section and passing through a linear aperture in an inferior headrail section, the linear aperture being parallel to the horizontal and relative to the length of the posterior headrail section;

(2) a second pin spaced apart from the first pin, fixedly attached to the superior headrail section, and passing through the linear aperture in the inferior headrail section; and (3) both the first and second pins movable secured to the inferior headrail section to allow movement of the first and second pins along and within the linear aperture, the pins being of such length to allow or prevent vertical movement between the headrail sections.

* * * * *

UNITED STATES PATENT AND TRADEMARK OFFICE

CERTIFICATE OF CORRECTION

PATENT NO. : 6,478,071 B1
DATED : November 12, 2002
INVENTOR(S) : Workman et al.

It is certified that error appears in the above-identified patent and that said Letters Patent is hereby corrected as shown below:

Title page,
Item [75], Inventors, change "Paul T. Rogers" to -- Paul T. Rodgers --

Signed and Sealed this

Twenty-seventh Day of April, 2004

JON W. DUDAS
*Acting Director of the United States Patent and Trademark Office*